US010312067B2

(12) United States Patent
Ikegami et al.

(10) Patent No.: US 10,312,067 B2
(45) Date of Patent: Jun. 4, 2019

(54) IMAGING MASS ANALYSIS DATA PROCESSING METHOD AND IMAGING MASS SPECTROMETER

(71) Applicant: SHIMADZU CORPORATION, Kyoto-shi, Kyoto (JP)

(72) Inventors: Masahiro Ikegami, Takaishi (JP); Shigeki Kajihara, Uji (JP)

(73) Assignee: SHIMADZU CORPORATION, Kyoto-shi, Kyoto (JP)

( * ) Notice: Subject to any disclaimer, the term of this patent is extended or adjusted under 35 U.S.C. 154(b) by 860 days.

(21) Appl. No.: 14/257,025

(22) Filed: Apr. 21, 2014

(65) Prior Publication Data

US 2014/0316717 A1 Oct. 23, 2014

(30) Foreign Application Priority Data

Apr. 22, 2013 (JP) ..... 2013-089399

(51) Int. Cl.
*H01J 49/00* (2006.01)

(52) U.S. Cl.
CPC ..... *H01J 49/0036* (2013.01); *H01J 49/0004* (2013.01)

(58) Field of Classification Search
None
See application file for complete search history.

(56) References Cited

U.S. PATENT DOCUMENTS 5,684,484 A * 11/1997 Suzuki ..... G01S 7/52025 341/155
7,228,239 B1 * 6/2007 Cetto ..... H01J 49/0036 436/171

(Continued)

FOREIGN PATENT DOCUMENTS

JP 2012-38459 A 2/2012
JP 2012-169979 A 9/2012

OTHER PUBLICATIONS

Guillaume Robichaud et al, "MSiReader: An Open-Source Interface to View and Analyze High Resolving Power MS Imaging Files on Matlab Platform", Journal of the American Society for Mass Spectrometry., vol. 24, No. 5, May 1, 2013, DOI:10.1007/s13361-013-0607-z, ISSN 1044-0305, XP055258817; figs. S2, S4, S5 (4 pages total).

Kiyohsi Ogawa, et al., "Kenbi Shitsuryou Bunseki Souchi No Kaihatsu (Research and Development of Mass Microscope)", Shimadzu Review, Mar. 31, 2006, pp. 125-135, vol. 62, Nos. 3 and 4.

Yuki Sugiura, et al., "Visualization of the Cell-Selective Distribution of PUFA-Containing Phosphatidylcholines in Mouse Brain by Imaging Mass Spectrometry", Journal of Lipid Research, Sep. 2009, pp. 1766-1788, vol. 50, No. 9.

(Continued)

*Primary Examiner* — Alexander Satanovsky
*Assistant Examiner* — Brent A. Fairbanks
(74) *Attorney, Agent, or Firm* — Sughrue Mion, PLLC

(57) ABSTRACT

If spatial measurement point intervals in imaging mass analysis data of two samples to be compared are different and the degrees of spatial distribution spreading of substances are compared, one of the data is defined as a reference, the measurement point intervals in the other of the data are redefined so as to be equalized to the reference, and a mass spectrum at each virtual measurement point set as a result of the redefinition is obtained through interpolation or extrapolation based on a mass spectrum at an actual measurement points. If the arrays of the m/z values of mass spectra are different for each sample, the m/z value positions of the mass spectrum in one of the data are defined as a reference, and the intensity values corresponding to the reference m/z values are obtained through interpolation or extrapolation for the mass spectrum of the other of the data.

24 Claims, 12 Drawing Sheets

(56) References Cited

U.S. PATENT DOCUMENTS

| | | | | |
|---|---|---|---|---|
| 2004/0102906 | A1* | 5/2004 | Roder | G06F 19/24 702/22 |
| 2007/0141719 | A1* | 6/2007 | Bui | H01J 49/0004 436/173 |
| 2010/0100577 | A1* | 4/2010 | Middleton | H01J 49/0036 708/308 |
| 2012/0133532 | A1 | 5/2012 | Hunt et al. | |
| 2012/0209854 | A1 | 8/2012 | Ikegami | |
| 2013/0035867 | A1 | 2/2013 | De Moor et al. | |
| 2013/0320203 | A1* | 12/2013 | Roder | G01N 33/487 250/282 |

OTHER PUBLICATIONS

Communication dated Mar. 30, 2016 from the European Patent Office in counterpart application No. 14165384.0.

Liam A. Mcdonnell, et al.; "Imaging Mass Spectrometry"; Mass Spectrometry Reviews; Jul. 1, 2007; vol. 26, No. 4; XP055081594; 38 pages total.

Robichaud Guillaume, et al., "MSiReader: An Open-Source Interface to View and Analyze High Resolving Power MS Imaging Files on Matlab Platform"; Journal of the American Society for Mass Spectrometry, Elsevier Science Inc., US; Mar. 28, 2013; vol. 24, No. 5; XP035354301; 4 pages total.

Douglas A. Simmons, et al., "A Practical Introduction to MALDI-MS Imaging"; Applied Biosystems; Sep. 1, 2008; www.maldi-msi.org/download/Imaging Overview Doug Simmons Sept_19_2008.pdf; 4 pages total.

Communication dated May 29, 2018, issued by the State Intellectual Property Office of the People's Republic of China in counterpart application No. 201610848369.7.

Communication dated Jun. 11, 2018, issued by the European Patent Office in counterpart application No. 14165384.0.

G. B. Eijkel et al., "Correlating MALDI and SIMS imaging mass spectrometric datasets of biological tissue surfaces", Surface and Interface Analysis, vol. 41, No. 8, Aug. 1, 2009 (Aug. 1, 2009), pp. 675-685, XP055477104, GB (11 pages total).

G. B. Eijkel et al., "Correlating MALDI and SIMS imaging mass spectrometric datasets of biological tissue surfaces", Surface and Interface Analysis, vol. 41, No. B, Aug. 1, 2009 (Aug. 1, 2009), pp. 675-685, XP055477104, GB (11 pages total).

* cited by examiner

IMAGING MASS ANALYSIS DATA PROCESSING METHOD AND IMAGING MASS SPECTROMETER

TECHNICAL FIELD

The present invention relates to a data processing method suitably applicable to an imaging mass spectrometer capable of obtaining an image showing the distribution of the ion signal intensity at a specific mass-to-charge ratio or within a mass-to-charge ratio range on a sample (such an image is hereinafter called a "mass analysis result image"), and relates to an imaging mass spectrometer using the data processing method.

BACKGROUND ART

Mass spectrometric imaging is a technique for examining the distribution of a substance having specific mass by performing a mass analysis on each of a plurality of small measurement areas (micro-areas) within a two-dimensional region on a sample, such as a piece of biological tissue. This technique is increasingly applied to, for example, discovery and development of new medicines, discovery of biomarkers, and investigation on the causes of various diseases. Mass spectrometers designed for mass spectrometric imaging are generally referred to as imaging mass spectrometers. This type of device may also be referred to as a microscopic mass spectrometer or a mass microscope since it performs a microscopic observation on an arbitrary two-dimensional region on a sample, selects an area to be analyzed based on the resultant microscopic observation image, and performs an imaging mass analysis on the selected area. The term "imaging mass spectrometer" will be used in this specification. For example, Non-Patent Literatures 1 and 2 disclose configurations of general imaging mass spectrometers and their analysis examples.

In an imaging mass spectrometer, mass spectrum data in a predetermined mass-to-charge ratio range is obtained for each of a large number of measurement points within a two-dimensional region on a sample. In order to do that at a high mass resolving power, normally, a time-of-flight mass spectrometer (TOFMS) is used as the mass spectrometer. In this case, the amount of mass spectrum data (or time-of-flight spectrum data) per measurement point is significantly larger than the amount of mass spectrum data in other mass spectrometers such as quadrupole mass spectrometers. Further, in order to obtain a fine mass analysis result image (that is, with an enhanced spatial resolving power), it is necessary to make the interval between the measurement points smaller, so that the number of measurement points on one sample becomes larger. Hence, if mass spectrometric imaging is performed at a high mass resolving power and a high spatial resolving power, the total amount of data per sample is enormous.

In order to create a mass analysis result image, display it, and statistically analyze the mass analysis result image through data processing using a general personal computer, it is necessary to read entire data to be processed into a main memory (generally, a RAM) of the computer. However, there is a restriction on the capacity of the main memory that is actually available in the general personal computer, and hence it is difficult to entirely read such high-resolution imaging mass analysis data as described above into the main memory. In this case, it is necessary to limit the range of images that can be created and displayed for mass analysis result in accordance with the restriction on the amount of data readable into the main memory, or, otherwise, use a part of an external memory device such as a hard disk drive as a virtual main memory, in which case the processing speed inevitably deteriorates.

Against these problems, Patent Literatures 1 to 3 each disclose a technique for storing mass spectrum data obtained by an imaging mass spectrometer after compressing it. The use of such a data compression technique makes it possible to reduce the size of imaging mass analysis data to be processed when reading it into a main memory. Further, according to the technique disclosed in Patent Literature 1, an index for associating the positions of the original (uncompressed) mass spectrum data in an array with the positions of the compressed data in the array is created, and the index is stored together with the compressed data or separately of the compressed data. Then, in the case where data (ion intensity value) corresponding to a given mass-to-charge ratio needs to be read, compressed data corresponding to the desired data is found with reference to such index information, and the data found is decompressed. In this way, desired data can be rapidly obtained even if data compression is used.

The ionization method of a MALDI ion source which is normally used for imaging mass spectrometers is suitable for biological samples, but it has a disadvantage in that the ion intensity fluctuates relatively large for each measurement (that is, for each laser irradiation). In order to compensate for such a disadvantage, when a mass spectrum is to be obtained for one measurement point, measurements are performed many times on the measurement point and the ion intensity signals thus obtained are summed. However, such summing is not always effective for eliminating fluctuations in ion intensity for each measurement point. Hence, even if a mass analysis result image is created using the ion intensity values at a specific mass-to-charge ratio obtained for each measurement point, the created mass analysis result image may not show the true distribution of a substance. In view of this, it is conventionally proposed to use ion intensity values that are normalized based on a predetermined reference instead of using raw ion intensity values at each measurement point, when a mass analysis result image is created.

For example, Non-Patent Literature 1 shows that it is adequate to perform TIC normalization or XIC normalization on imaging mass analysis data and then create, display, and statistically analyze a mass analysis result image. Here, TIC stands for "total ion current", and means the sum of the ion intensity values within the entire mass-to-charge ratio range on a mass spectrum obtained at each measurement point. With the TIC normalization, the intensity value at each mass-to-charge ratio is normalized so that the TIC at each measurement point is the same. Meanwhile, XIC stands for "extract ion current", and means the sum of the ion intensity values in a designated mass-to-charge ratio or within a mass-to-charge ratio range on a mass spectrum obtained at each measurement point. With the XIC normalization, the intensity value in each mass-to-charge ratio is normalized such that the XIC at each measurement point is the same, and hence the height of a peak corresponding to a specific mass-to-charge ratio can be equalized at each measurement point.

Further, in order to enable an operator (user) to decide a mass-to-charge ratio or mass-to-charge ratio range for displaying a mass analysis result image, the operator refers in many cases to an average mass spectrum of all measurement points or measurement points within a region of interest on which the operator focuses attention. Creation based on TIC-normalized or XIC-normalized ion intensity values is effective also for such an average mass spectrum.

In mass spectrometric imaging, a common practice is to perform an analysis in which a plurality of imaging mass analysis data respectively obtained from different samples are compared with each other. For example, for a diagnosis of a disease such as a cancer, it is effective to: compare imaging mass analysis data obtained from a piece of biological tissue collected from a healthy body with imaging mass analysis data obtained from a piece of biological tissue collected from a subject; evaluate similarities and differences between them; and analyze different portions in detail. A method used for an objective analysis for such comparison is a statistical analysis such as the principal component analysis on imaging mass analysis data obtained from different samples.

For example, Non-Patent Literature 1 discloses an effective method of comparing plural samples with each other. In the method, peak matrix data is generated for each of imaging mass analysis data of different samples, the plurality of peak matrix data are combined and a statistical analysis is performed on the combined data. Specifically, first, the mass-to-charge ratios of a plurality of peaks to be statistically analyzed are determined in advance for a plurality of imaging mass analysis data to be compared. For example, the mass-to-charge ratios of a plurality of specific peaks are selected from: an average mass spectrum obtained by averaging the mass spectra at all the measurement points of the imaging mass analysis data to be compared; or a maximum intensity mass spectrum obtained by obtaining the maximum intensity in each mass-to-charge ratio of the mass spectrum over all the measurement points and reconstructing the obtained maximum intensity values as a spectrum. Then, from the mass spectrum that is obtained at each measurement point for each sample, the ion intensity value corresponding to the selected mass-to-charge ratio value is obtained, and a peak matrix in which the mass-to-charge ratio value and the ion intensity value are paired is created for each measurement point. After that, the peak matrix data for the plurality of measurement points on the plurality of samples are combined and created into one peak matrix data.

Further, in the statistical analysis disclosed in Non-Patent Literature 1, when peak matrix data of different samples are combined, the intensity values are normalized based on the above-mentioned TIC. As described above, the TIC normalization can reduce influences of fluctuations in an ion intensity value for each sample and influences of fluctuations in amount of ions that are generated for each measurement point by a MALDI ion source, which result from differences in samples, preprocessing, measurement dates, measurement conditions, and other factors. As a result, an effective statistical analysis can be performed.

As described above, in order to combine peak matrices created from the imaging mass analysis data of different samples, it is necessary to calculate an average mass spectrum or a maximum intensity mass spectrum of all measurement points or a plurality of specific measurement points for the imaging mass analysis data to be compared, and then determine in advance the mass-to-charge ratios of a plurality of peaks to be statistically analyzed. This processing is based on the presumption that all the mass-to-charge ratio values of a plurality of mass spectrum data included in the imaging mass analysis data to be compared are the same, in other words, the respective mass-to-charge ratio values at a large number of data points constituting each mass spectrum are common among all mass spectra.

In actual, however, mass spectrometric imaging on a plurality of samples to be compared is not necessarily performed under the same measurement conditions, and imaging mass analysis data obtained by different devices may be compared with each other in some cases. For example, in the case of a mass spectrum obtained by a time-of-flight mass spectrometer, the ion signal intensity is obtained from a detector at regular time intervals from the arrival time at which an ion at the lower limit of a mass-to-charge ratio range to be measured arrives at the detector, and each obtained time is replaced with its corresponding mass-to-charge ratio value to be configured as mass spectrum data. Even if the same device is used, the mass-to-charge ratio value corresponding to the ion time-of-flight needs to be changed appropriately in order to compensate for a change in ion flight distance due to the ambient temperature or other environmental factors. Under such circumstances, the mass-to-charge ratio values at the data points of the plurality of imaging mass analysis data to be compared are not the same in many cases. Further, the measurement point intervals on each sample (in other words, the effective sizes of micro measurement areas for one mass spectrum data) at the time of the mass spectrometric imaging may be different for each sample.

As described above, in the case where the mass-to-charge ratio values at the data points constituting a mass spectrum are different for each sample or where the sizes of the micro measurement areas for a mass spectrum are different for each sample, the peak matrices respectively obtained from the imaging mass analysis data of the plurality of samples cannot be combined according to the above-mentioned conventional method. Hence, in the case where the plurality of samples are to be compared with each other using the statistical analysis, for example, it is necessary to perform the statistical analysis on the peak matrices respectively obtained from the imaging mass analysis data of the samples, adjust the plurality of statistical analysis results thus obtained to be comparable with each other, and then compare the statistical analysis results with each other. Such work is much complicated, and may lower the accuracy of comparison evaluation.

Further, in the case where the plurality of samples are compared with each other as described above, it is also important that: mass analysis result images in specific mass-to-charge ratios or within mass-to-charge ratio ranges on which an operator (user) focuses attention be simultaneously displayed; and the operator subjectively evaluate similarities and the like between them while visually checking the displayed mass analysis result images. However, in the case where the mass-to-charge ratio values at the data points constituting a mass spectrum are different for each sample or where the sizes of the micro measurement areas for a mass spectrum are different for each sample, even if the two-dimensional distribution of a target substance is the same among the plurality of samples, how it looks may be different among them. As a result, the operator may make erroneous subjective determination and evaluation.

Still further, the mass-to-charge ratio values at the data points constituting a mass spectrum are normally equal for each measurement point in imaging mass analysis data for one sample. However, in the case where a change in ion flight distance due to a change in temperature and other factors is corrected as appropriate during the measurement in the time-of-flight mass spectrometer, or depending on how to set measurement conditions, the mass-to-charge ratio values at the data points constituting a mass spectrum may be different for each measurement point. For example, in a measurement method conceivable to reduce the measurement time, only a region of interest that is designated by the operator within the measurement region on one sample is measured at a high mass resolving power, and the other region than the region of interest is measured at a low mass resolving power. It is difficult to create peak matrices for a statistical analysis from the imaging mass analysis data collected under such a condition, regardless of whether or not to combine the peak matrices respectively generated from the plurality of imaging mass analysis data as described above.

CITATION LIST

Patent Literature

[Patent Literature 1] JP 2012-169979 A
[Patent Literature 2] JP 2012-038459 A
[Patent Literature 3] US 2012/0133532 A

Non-Patent Literature

[Non-Patent Literature 1] Kiyoshi Ogawa et al., "Kenbi Shitsuryou Bunseki Souchi No Kaihatsu (Research and Development of Mass Microscope)", Shimadzu Review, Mar. 31, 2006, vol. 62, nos. 3.4, pp. 125-135
[Non-Patent Literature 2] Takahiro Harada et al., "Kenbi Shitsuryou Bunseki Souchi Ni Yoru Seitai Soshiki Bunseki (Biological Tissue Analysis Using Mass Microscope)", Shimadzu Review, Apr. 24, 2008, vol. 64, nos. 3.4, pp. 139-145
[Non-Patent Literature 3] Yuki Sugiura et al., "Visualization of the Cell-Selective Distribution of PUFA-Containing Phosphatidylcholines in Mouse Brain by Imaging Mass Spectrometry", Journal of Lipid Research, 2009, vol. 50, pp. 1766-1788

SUMMARY OF INVENTION

Technical Problem

The present invention, which has been made in view of the above-mentioned problems, has a main object to provide an imaging mass analysis data processing method and an imaging mass spectrometer in which, in the case where a statistical analysis and simultaneous display of mass analysis result images are performed in order to compare the imaging mass analysis data of a plurality of samples with each other, even if the measurement point intervals are different for each sample or if the mass-to-charge ratio values at the data points constituting a mass spectrum are different for each sample, influences of such differences can be eliminated, and an accurate statistical analysis and simultaneous display of mass analysis result images can be simply performed.

The present invention has another object to provide an imaging mass analysis data processing method and an imaging mass spectrometer in which, even if the measurement point intervals are different within imaging mass analysis data of one sample or if the mass-to-charge ratio values at the data points constituting a mass spectrum are different for each measurement point, influences of such differences can be eliminated, and an accurate statistical analysis and simultaneous display of mass analysis result images can be simply performed.

Solution to Problem

A first aspect of the present invention aimed at solving the above-mentioned problems provides an imaging mass analysis data processing method of processing imaging mass analysis data in which mass spectrum data collected by performing a mass analysis on each of a plurality of measurement points on a sample is associated with spatial position information of the measurement point, including:

a) a spatial correction step in which a spatial measurement point interval in one of a plurality of imaging mass analysis data is defined as a reference, and mass spectrum data at each of virtual measurement point positions in the other imaging mass analysis data is obtained through interpolation or extrapolation using mass spectrum data at a plurality of measurement points around the virtual measurement point position, the virtual measurement point positions being virtual positions in the other imaging mass analysis data if the measurement point interval is equalized to the reference;

b) a mass-to-charge ratio correction step in which a mass-to-charge ratio range common to mass spectra in the plurality of imaging mass analysis data is extracted, mass-to-charge ratio points within the extracted common mass-to-charge ratio range in one of the plurality of imaging mass analysis data are defined as references, and an intensity value at each of virtual mass-to-charge ratio points in the other imaging mass analysis data is obtained through interpolation or extrapolation using intensity values at actually measured mass-to-charge ratio points before and after the virtual mass-to-charge ratio point, the virtual mass-to-charge ratio points in the other imaging mass analysis data being mass-to-charge ratio points if the mass-to-charge ratio points in the other imaging mass analysis data are equalized to the references; and c) a combining step, in which the plurality of imaging mass analysis data in which the measurement point intervals and the mass-to-charge ratio points are equalized by performing the spatial correction step and the mass-to-charge ratio correction step are combined so as to be treatable as one imaging mass analysis data.

Note that, in a time-of-flight mass spectrometer, a time-of-flight spectrum is created based on signals obtained by an ion detector, and the time-of-flight of each ion on the time-of-flight spectrum is converted into a mass-to-charge ratio, whereby a mass spectrum is created. Accordingly, in the imaging mass analysis data processing method according to the first aspect of the present invention, the term "mass spectrum" includes a "time-of-flight spectrum" expressed using times-of-flight before conversion into mass-to-charge ratios.

In the imaging mass analysis data processing method according to the first aspect of the present invention, in the case where imaging mass analysis data of a plurality of samples are given and where the measurement point intervals in the imaging mass analysis data are different for each sample, a correction process for equalizing the measurement point intervals different for each sample is performed in the spatial correction step. That is, a spatial measurement point interval in one of the imaging mass analysis data is defined as a reference, virtual measurement point positions when measurement point intervals in the other imaging mass analysis data are equalized to the reference are obtained, and mass spectrum data at each of the virtual measurement point positions is calculated through interpolation or extrapolation using mass spectrum data at a plurality of actual measurement points around the virtual measurement point position. The technique for the interpolation or the extrapolation is not particularly limited: a higher-order function, a spline function, and other such functions as well as a simple linear function may be used.

Further, in the case where mass-to-charge ratio points constituting mass spectra in the plurality of imaging mass analysis data are different for each sample, a correction process for equalizing the mass-to-charge ratio points different for each sample is performed in the mass-to-charge ratio correction step. That is, first, in order to equalize mass-to-charge ratio ranges of the mass spectra, a mass-to-charge ratio range common to the mass spectra in the imaging mass analysis data of the plurality of samples is extracted. After that, mass-to-charge ratio points within the common mass-to-charge ratio range in one of the imaging mass analysis data are defined as a references, virtual mass-to-charge ratio points when mass-to-charge ratio points in the other imaging mass analysis data are equalized to the references are obtained, and an ion intensity value at each of the virtual mass-to-charge ratio points is calculated through interpolation or extrapolation using intensity points at actually measured mass-to-charge ratio points before and after the virtual mass-to-charge ratio point. Similarly to the correction of measurement points, the technique for the interpolation or the extrapolation is not particularly limited, and a higher-order function, a spline function, and other such functions as well as a simple linear function may be used.

Through the processing as described above, the measurement point intervals in the imaging mass analysis data of the plurality of samples and the arrays of the mass-to-charge ratio points in the mass spectra are equalized. Any of the measurement point correction and the mass-to-charge ratio correction may be performed first. Further, in the case where the degrees of spreading (specifically, the areas or sizes) of substances do not need to be compared at the time of comparing the plurality of samples and where it is sufficient to compare only the spatial distribution conditions, even if the measurement point intervals are different for each sample, the measurement point intervals in any one of the imaging mass analysis data are defined as a reference, and the measurement point intervals in the other imaging mass analysis data are simply enlarged or shrunken, whereby the measurement point intervals can be equalized. In this case, such intensity value conversion (correction) as in the spatial correction step is not necessary.

That is, the spatial correction step in the imaging mass analysis data processing method according to the first aspect of the present invention may be a spatial correction step, in which spatial measurement point intervals in one of a plurality of imaging mass analysis data are defined as a reference, and measurement point intervals in the other imaging mass analysis data are equalized to the reference through enlargement or shrinkage.

Then, in the combining step, the plurality of imaging mass analysis data in which the measurement point intervals and the mass-to-charge ratio values are equalized are combined with each other so as to be treatable as one imaging mass analysis data. The combining in this case refers to a process for changing the association with spatial position information as if the imaging mass analysis data of the plurality of samples, each of which is associated with different spatial position information, were one imaging mass analysis data of one sample. In general, measurement regions on samples from which imaging mass analysis data is obtained have various shapes and sizes. If a blank portion is formed between the original measurement regions after data combining, the combined data is difficult to treat as one imaging mass analysis data. In view of this, for example, a rectangular region circumscribing all the measurement regions may be assumed, and data having an intensity value of zero may be inserted as dummy data to each blank measurement point in the rectangular region. Alternatively, a flag indicating whether the data is valid or invalid may be prepared for each measurement point, and whether the data at each measurement point within the rectangular region is valid or invalid may be determined using the flag, at the time of certain data processing.

Preferably, the imaging mass analysis data processing method according to the first aspect of the present invention may further include:

d) a spectrum creation step, in which an arithmetic mass spectrum that is a summed mass spectrum, an average mass spectrum, or a maximum intensity mass spectrum of mass spectra at a plurality of designated or specific measurement points is calculated based on the imaging mass analysis data combined in the combining step;

e) a peak matrix creation step, in which peak detection is performed on the arithmetic mass spectrum, a list of mass-to-charge ratio values of the detected peaks is created, intensity values respectively corresponding to mass-to-charge ratios in the list are obtained from the mass spectrum data at each of the measurement points, and a peak matrix is created by arraying the intensity values in accordance with the corresponding mass-to-charge ratio values; and f) a statistical analysis step, in which a statistical analysis is performed on the peak matrix.

Here, the maximum intensity mass spectrum is a mass spectrum obtained by extracting peaks that are maximum intensities for each mass-to-charge ratio in the mass spectra at all the measurement points and reconstructing the extracted peaks as a spectrum.

As described above, the imaging mass analysis data obtained from the plurality of samples are combined with each other so as to be treatable as if they were one imaging mass analysis data, and both the measurement point intervals and the arrays of the mass-to-charge ratio points of the mass spectra are equalized. Hence, both of the calculation of the arithmetic mass spectrum in the spectrum creation step and the creation of the peak matrix in the peak matrix creation step can be performed without any problem. Meanwhile, statistical analysis results obtained in the statistical analysis step are analysis results for the imaging mass analysis data obtained from the plurality of samples. Hence, the plurality of samples can be easily compared with each other based on the analysis results.

Preferably, the imaging mass analysis data processing method according to the first aspect of the present invention may further include g) an image creation step, in which a mass analysis result image showing two-dimensional distribution of unnormalized intensity values in a designated or specific mass-to-charge ratio or within a designated or specific mass-to-charge ratio range is created based on the imaging mass analysis data combined in the combining step.

As a result, mass analysis result images for the plurality of samples can be simultaneously created and displayed. Moreover, the measurement point intervals and the mass-to-charge ratio points in the plurality of simultaneously displayed mass analysis result images are equalized, which is advantageous for an operator to visually compare the mass analysis result images with each other.

The imaging mass analysis data processing method according to the first aspect of the present invention may further include a normalization coefficient creation step, in which a normalization coefficient for normalizing intensity values of the mass spectrum data at each of measurement points according to a predetermined reference is calculated for each of the measurement points, and the calculation result is stored. The image creation step may include:

normalizing an intensity value at each of the measurement points on the mass analysis result image, using the normalization coefficient; and creating a normalized mass analysis result image.

Alternatively, the imaging mass analysis data processing method according to the first aspect of the present invention may further include a normalization coefficient creation step, in which a normalization coefficient for normalizing intensity values of the mass spectrum data at each of measurement points according to a predetermined reference is calculated for each of the measurement point, and the calculation result is stored. The spectrum creation step may include: normalizing the mass spectra at the plurality of designated or specific measurement points, using the normalization coefficient, based on the imaging mass analysis data combined in the combining step; and calculating at least any one of the summed mass spectrum, the average mass spectrum, and the maximum intensity mass spectrum, from the normalized mass spectra.

In the normalization coefficient creation step, the coefficient for normalizing the intensity value of the mass spectrum data at each of measurement points according to the predetermined reference is calculated for each of the measurement points, and the calculation result is stored into, for example, a memory unit. Here, the technique for the normalization is, for example, the TIC normalization or the XIC normalization.

Because the normalization coefficients are calculated and stored in advance as described above, in the case where a mass analysis result image is to be obtained based on normalized intensity values for a mass analysis result image at a given mass-to-charge ratio, it is sufficient to simply multiply the intensity value at each of the measurement points by the normalization coefficient. Hence, the normalized mass analysis result image can be extremely rapidly created and displayed. Similarly, in the case where a normalized average mass spectrum is to be displayed, the average mass spectrum can be rapidly recalculated and displayed.

The imaging mass analysis data processing method according to the first aspect of the present invention may further include a compression step, in which, for the imaging mass analysis data combined in the combining step, the mass spectrum data at each of the measurement points is compressed according to a predetermined algorithm, and the resultant compressed data is stored into a memory unit. Any of the arithmetic mass spectrum, the peak matrix, and the mass analysis result image may be created by reading necessary data of the compressed data stored in the memory unit, out of the memory unit and decompressing the read data.

Here, the encoding method for the compression is not particularly limited, and, for example, run-length encoding, entropy encoding, or their combination may be used.

If the imaging mass analysis data of the plurality of samples are combined with each other, the number of measurement points may be increased by equalizing the measurement point intervals, and hence the amount of the combined data may be larger than the total amount of all of imaging mass analysis data. Even in this case, through data compression, data necessary for the creation of mass analysis result images, the statistical analysis, and other processing can be stored into, for example, a main memory of a computer. Accordingly, at the time of the creation of mass analysis result images for sample comparison, the statistical analysis, and other processing, necessary imaging mass analysis data does not need to be read each time out of an external memory device such as a hard disk drive, so that an increase in processing speed and a reduction in device load can be achieved.

Note that, although compressed data can be decompressed as it is, it may take time to obtain the intensity value corresponding to a specific mass-to-charge ratio, depending on a data compression method used. In view of this, preferably, index information in which the compressed data is associated with position information of intensity values in an array of original data may be stored in a third area of the memory unit in addition to the compressed data, and the intensity value corresponding to the specific mass-to-charge ratio may be obtained with reference to the index information.

As a result, a decompression process for obtaining the intensity value corresponding to an arbitrary mass-to-charge ratio from the compressed data can be performed at high speed, and hence the displaying speed of a mass analysis result image or an average mass spectrum or the creating speed of a peak matrix is increased using the compressed data.

The process for equalizing the measurement point intervals or the arrays of the mass-to-charge ratio points in the imaging mass analysis data processing method according to the first aspect of the present invention can also be applied to the case where the measurement point intervals or the arrays of the mass-to-charge ratio points are different in imaging mass analysis data of one sample.

That is, a second aspect of the present invention aimed at solving the above-mentioned problems provides an imaging mass analysis data processing method of processing imaging mass analysis data in which mass spectrum data collected by performing a mass analysis on each of a plurality of measurement points on a sample is associated with spatial position information of the measurement point, including:

a) a spatial correction step, in which a specific spatial measurement point interval in one imaging mass analysis data is defined as a reference, and mass spectrum data at each of virtual measurement point positions is obtained through interpolation or extrapolation using mass spectrum data at a plurality of measurement points around the virtual measurement point position, the virtual measurement point positions being virtual positions if the other measurement point interval is equalized to the reference; and b) a mass-to-charge ratio correction step, in which a mass-to-charge ratio range common to mass spectra at measurement points included in the one imaging mass analysis data is extracted, mass-to-charge ratio points of a mass spectrum at a specific measurement point are defined as references, and an intensity value at each of virtual mass-to-charge ratio points is obtained through interpolation or extrapolation using intensity values at actually measured mass-to-charge ratio points before and after the virtual mass-to-charge ratio point, the virtual mass-to-charge ratio points being virtual mass-to-ratio point if the mass-to-charge ratio points constituting mass spectra at the other measurement points are equalized to the references.

The present invention aimed at solving the above-mentioned problems provides an imaging mass spectrometer including: an imaging mass spectrometer unit for performing a mass analysis on each of a plurality of measurement points on a sample and collecting mass spectrum data; and a data processor for implementing the imaging mass analysis data processing method according to the present invention.

Here, the configuration of the imaging mass spectrometer unit (specifically, the type of an ion source and the type of a mass spectrometer) is not particularly limited. Typically, the ion source is a MALDI ion source, and the mass spectrometer is a time-of-flight mass spectrometer. Further, the imaging mass spectrometer unit may include an ion dissociator for dissociating ions at one or more stages through, for example, collision-induced dissociation, and may be capable of performing a mass analysis on product ions generated by the ion dissociator. Further, the imaging mass spectrometer unit may include an optical microscope for observing a sample and an imaging device for converting an obtained optical image into image data.

Advantageous Effects of Invention

In the imaging mass analysis data processing method and the imaging mass spectrometer according to the present invention, for the imaging mass analysis data obtained from a plurality of different samples, even if the arrays of mass-to-charge points constituting a mass spectrum are different for each sample, the arrays of the mass-to-charge points can be equalized by correcting intensity values. Further, even if the measurement point intervals are different for each sample, the measurement point intervals can be equalized by newly setting a virtual measurement points and correcting intensity values such that a mass spectrum at the virtual measurement points are obtained. Because the measurement point intervals and the arrays of the mass-to-charge ratio are equalized in this way, the imaging mass analysis data of the plurality of samples can be treated as if they were one imaging mass analysis data. As a result, even if the measurement point intervals and the like are not equal originally, a statistical analysis or the simultaneously display of mass analysis result images can be performed, in order to compare the plurality of imaging mass analysis data. Further, a conventional processing for one imaging mass analysis data can be applied without any change, which is simple. Further, the accuracy of comparison of the mass analysis result images is improved.

DESCRIPTION OF EMBODIMENTS

An embodiment of an imaging mass analysis data processing method and an imaging mass spectrometer using the method according to the present invention is hereinafter described with reference to the attached drawings.

Figure 1:
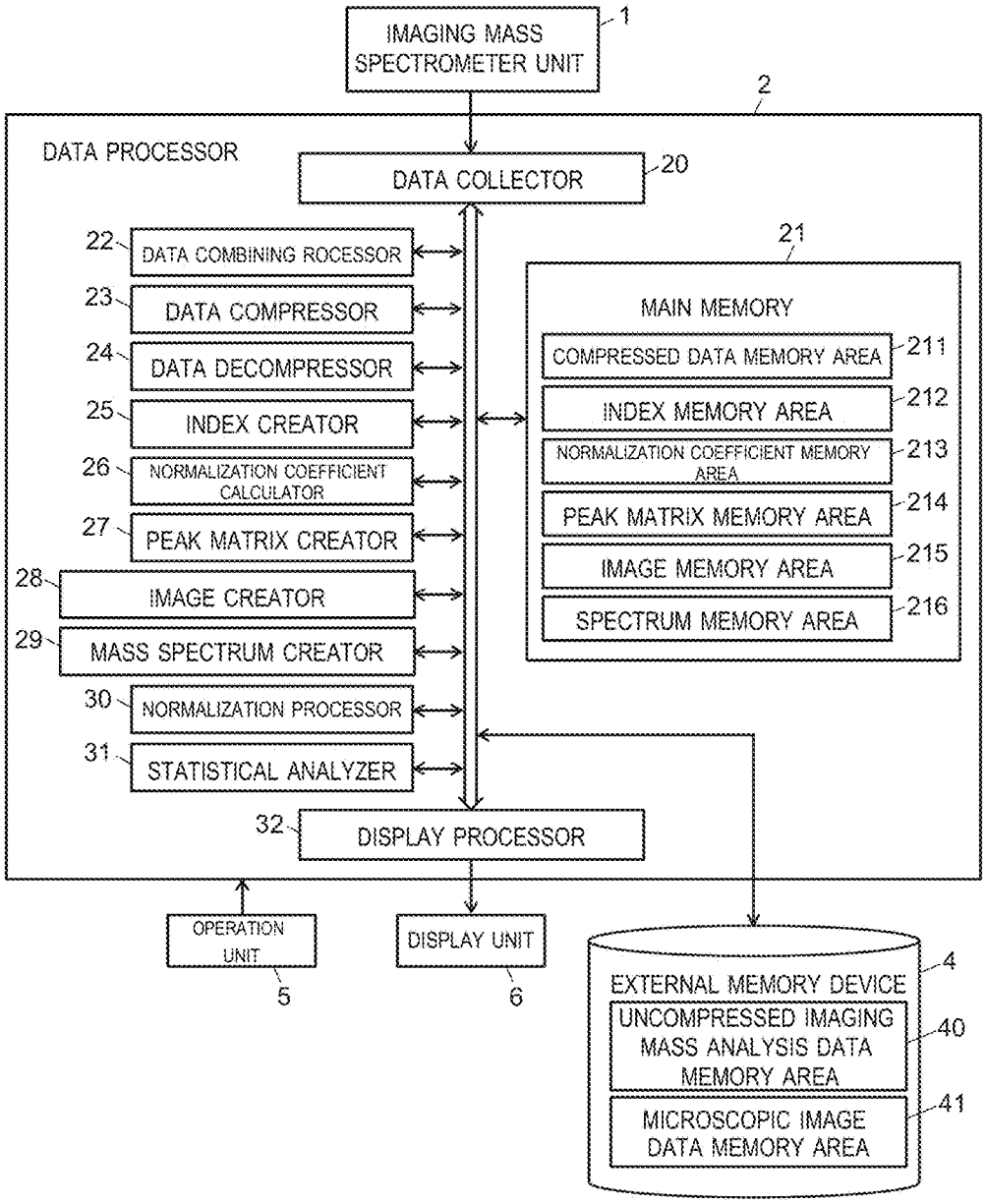
FIG. 1 is a schematic configuration diagram showing an embodiment of an imaging mass spectrometer system for implementing an imaging mass analysis data processing method according to the present invention.

FIG. 1 is a configuration diagram showing a main part of an imaging mass spectrometer system capable of implementing the imaging mass analysis data processing method that is an embodiment of the present invention.

The imaging mass spectrometer system includes: an imaging mass spectrometer unit 1 for performing a mass analysis on each of a large number of two-dimensional measurement points on a sample and obtaining mass spectrum data within a predetermined mass-to-charge ratio range for each of the measurement points; a data processor 2 for performing various types of data processing (to be described later) on the obtained data; a large-capacity external memory device 4 (for example, a hard disk drive (HDD) and a solid state drive (SSD)) for storing the raw mass spectrum data obtained by the imaging mass spectrometer unit 1; an operation unit 5 to be operated by an operator; and a display unit 6 for displaying analysis results or other information. The data processor 2 is actually a personal computer including a CPU, RAM, ROM and other components, or a higher-performance workstation. The data processor 2 includes, as its functional blocks, a data collector 20, a main memory 21, a data combining processor 22, a data compressor 23, a data decompressor 24, an index creator 25, a normalization coefficient calculator 26, a peak matrix creator 27, an image creator 28, a mass spectrum creator 29, a normalization processor 30, a statistical analyzer 31, and a display processor 32.

Figure 13:
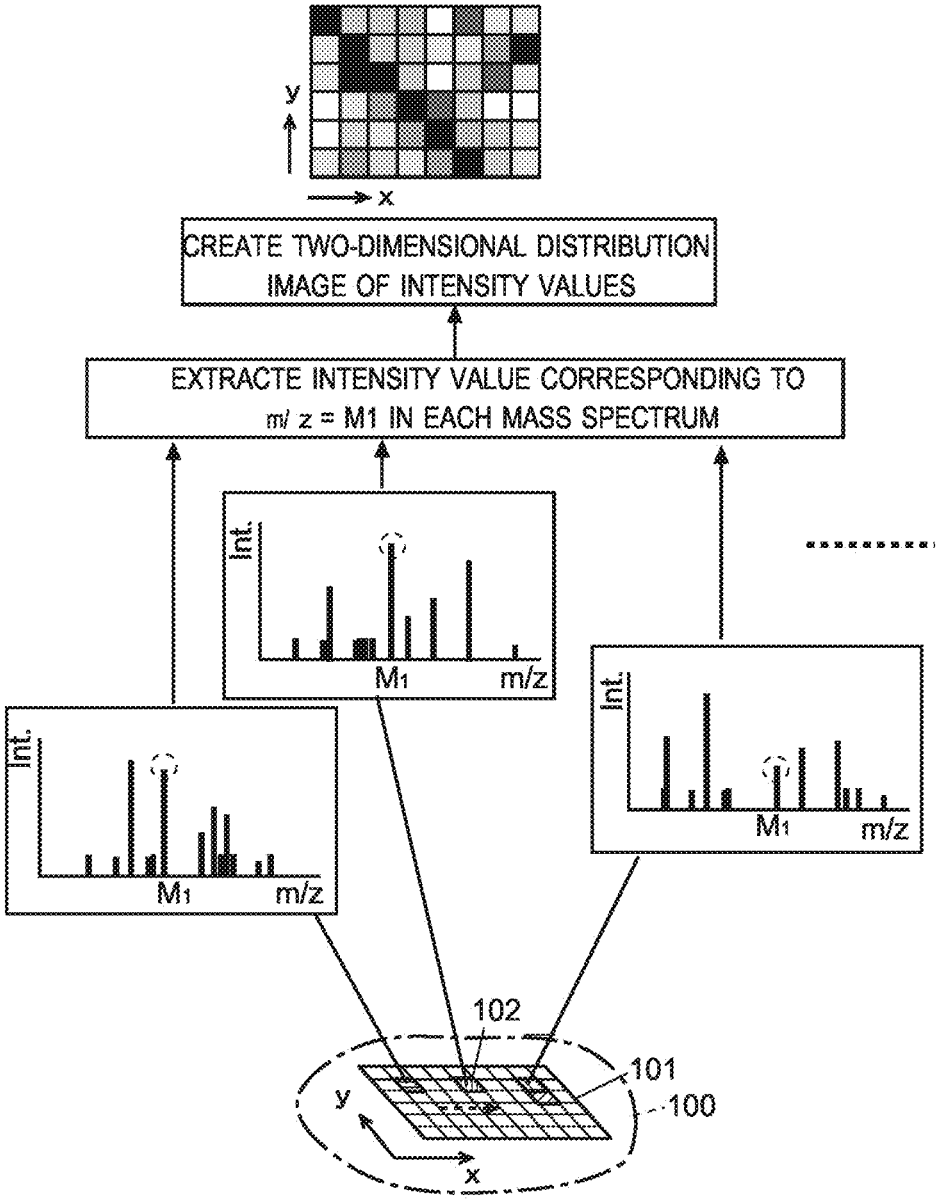
FIG. 13 is a schematic diagram illustrating the content of data obtained through an imaging mass analysis and two-dimensional mass analysis result image display using the obtained data.

As shown in FIG. 13, the imaging mass spectrometer unit 1 performs a mass analysis on each of a large number of measurement points (micro regions) 102 set within a measurement region 101 that is designated on a sample 100 by the operator. Herein, although the configuration of the imaging mass spectrometer unit 1 is not particularly limited, generally, the imaging mass spectrometer unit 1 includes a mass spectrometer unit in which a MALDI ion source and a TOFMS are combined with each other, and a sample stage (not shown) on which the sample 100 is put is moved with high accuracy in two axial directions (an x-axis and a y-axis), whereby a mass analysis on an arbitrary position on the sample 100 is possible. Note that the shape of the measurement region 101 does not necessarily need to be such a rectangular shape as shown in FIG. 13, and can be an arbitrary shape.

The imaging mass spectrometer unit 1 preferably includes an optical microscope and an imaging device including a CCD image sensor, a CMOS image sensor, or other sensors. The imaging mass spectrometer unit 1 takes an image having resolution sufficiently higher than the measurement point intervals on the sample 100, and presents the taken image to the operator via the data collector 20, the display processor 32, and the display unit 6. If the operator refers to the presented image and designates a region corresponding to the measurement region 101 through the operation unit 5, the data processor 2 calculates coordinate information of the designated region. The imaging mass spectrometer unit 1 drives the sample stage to the positional coordinates corresponding to the designated region, and performs a mass analysis on each of the measurement points within the designated region, and then obtain mass spectrum data.

The data collector 20 reads the mass spectrum data that is obtained by the imaging mass spectrometer unit 1 through the mass analysis and the microscopic observation image data taken by the imaging mass spectrometer unit 1, and respectively stores the read data into an uncompressed imaging mass analysis data memory area 40 and a microscopic image data memory area 41 of the external memory device 4. The data collected from one sample may be collectively stored into, for example, one data file. In the case of comparing a plurality of samples with each other, imaging mass analysis data is collected for each of the plurality of samples, and a process for comparing the collected imaging mass analysis data with each other is then performed.

Hereinafter, description is given in detail of a processing operation of the data processor 2 in the case of performing a comparison analysis using the imaging mass analysis data of the plurality of samples stored in the external memory device 4.

Figure 2:
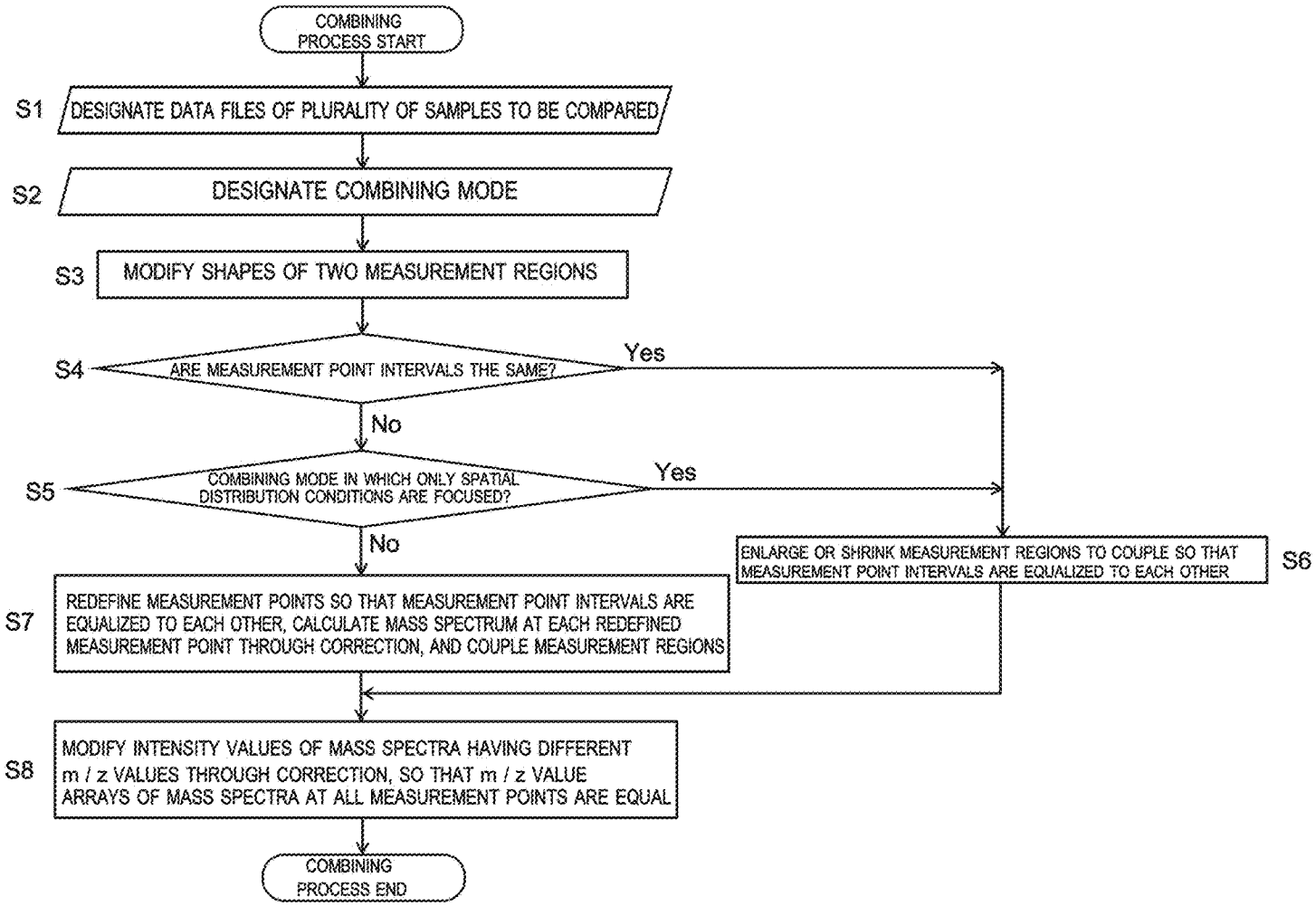
FIG. 2 is a flowchart when the imaging mass analysis data of a plurality of samples are combined with each other in the imaging mass spectrometer system of the present embodiment.

In the system of the present embodiment, data to be processed (data to be subjected to a mass analysis result image creation, a statistical analysis, and other processing) is once stored in the main memory 21, and the data can be processed by only reading and writing with respect to the main memory 21, without making access to the data in the external memory device 4. Accordingly, as described later, the imaging mass analysis data is compressed and written into a compressed data memory area 211 of the main memory 21, after a process for combining the imaging mass analysis data of the plurality of samples to be compared so that the imaging mass analysis data can be treated as if they were one imaging mass analysis data. FIG. 2 is a flowchart showing the combining process that is performed by the data combining processor 22 on the imaging mass analysis data of the plurality of samples.

[Combining Process for Imaging Mass Analysis Data]

First, the operator designates data files that respectively store the plurality of imaging mass analysis data to be combined, through the operation unit 5 (Step S1). Further, the operator selects and designates either of a combining mode in which only spatial distribution conditions are focused or a combining mode in which spatial distribution conditions and spatial spreading sizes are focused, depending on an analysis purpose and the like (Step S2).

For convenience sake, the following description is given by taking an example case of combining two imaging mass analysis data, that is, one imaging mass analysis data of a sample A and one imaging mass analysis data of a sample B, but it is apparent from the following description that three or more imaging mass analysis data can be combined with each other by repeating the combining process.

Figure 3:
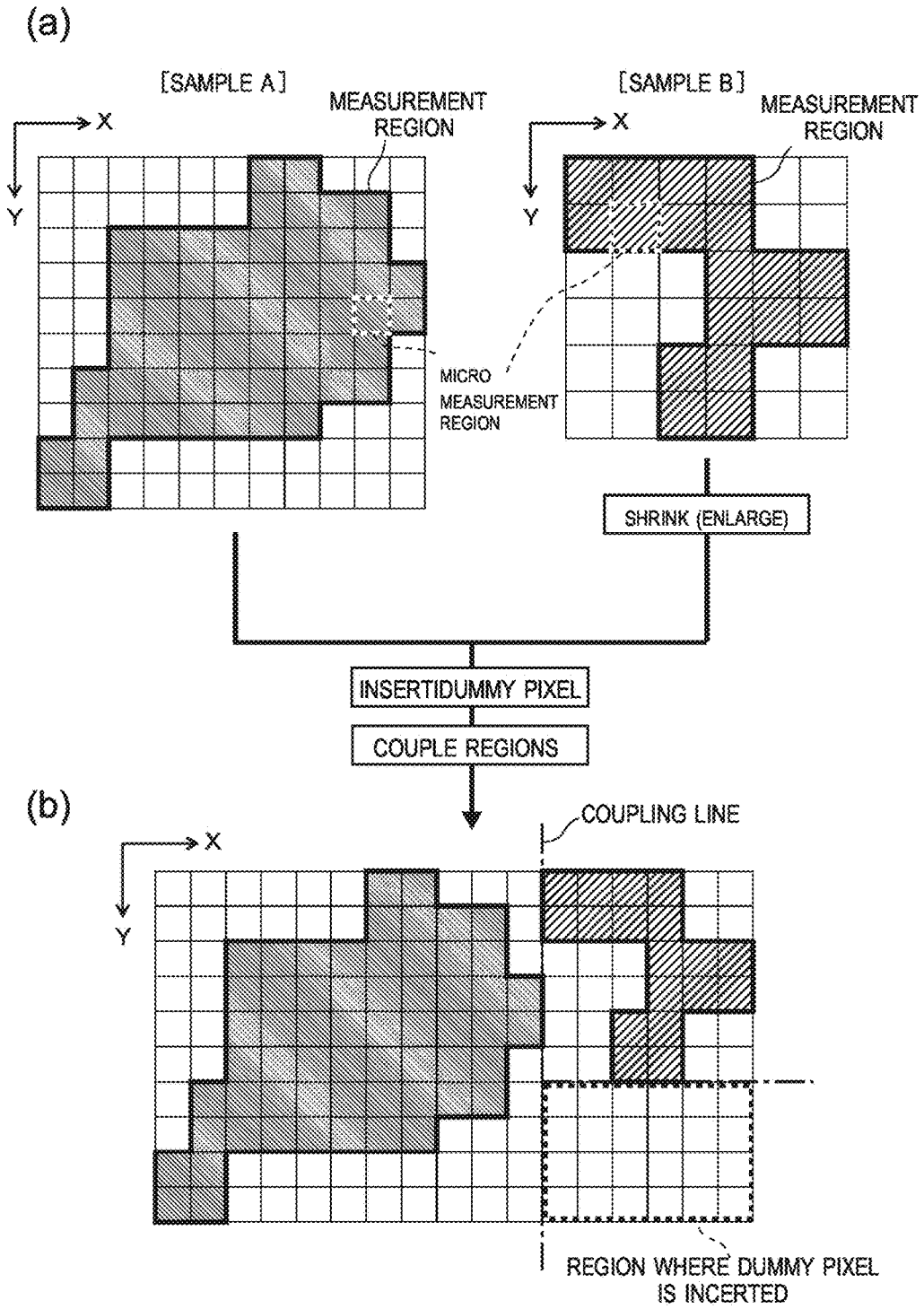
FIG. 3 are conceptual diagrams showing measurement region combining in the case of comparison in which only the spatial distribution conditions of a substance are focused in the imaging mass spectrometer system of the present embodiment.

Now, it is assumed that the respective imaging mass analysis data of the samples A and B are obtained from such measurement regions as shown in FIG. 3(*a*). FIG. 3(*a*) shows the respective measurement regions on the samples in plan view, and the size ratio of the measurement region on the sample A to the measurement region on the sample B represents the actual size ratio on the samples. Further, each range obtained by sectioning the inside of a rectangular region including the measurement region in a grid-like pattern represents a micro measurement region corresponding to one measurement point. That is, the X-directional size and the Y-directional size of this micro measurement region are respectively equal to the X-directional measurement point interval and the Y-directional measurement point interval.

Because the shape of each measurement region is arbitrary as described above, in the case where measurement regions to be combined are not rectangular, the shapes of the measurement regions to be combined are each modified into a rectangular shape (Step S3). Specifically, for example, as shown in FIG. 3(*a*), a rectangular region circumscribing each measurement region having an arbitrary shape is set, and the inside of the rectangular region is sectioned at the same measurement point intervals as those in the measurement region. Then, dummy data having an intensity value of zero is inserted to every measurement point in the other region than the measurement region. Alternatively, a determination flag indicating whether each measurement point is valid or invalid may be held per bit correspondingly to the measurement point. With such determination flags, measurement points (micro measurement regions) included in the inside of the measurement region are regarded as valid measurement points, whereas measurement points inside of the rectangular region and outside of the measurement region are regarded as invalid measurement points.

Subsequently, it is determined whether or not the measurement point intervals of the two measurement regions to be combined are the same as each other (Step S4). If it is determined that the measurement point intervals are not the same, then it is determined whether or not the combining mode in which only spatial distribution conditions are focused is designated in Step S2 (Step S5). If it is determined that the measurement point intervals are the same or if it is determined that the combining mode in which only spatial distribution conditions are focused is designated, as shown in FIG. 3(*b*), the two measurement regions are coupled to each other so that the appearance measurement point intervals of the two measurement regions are equalized to each other (Step S6). If the measurement point intervals are not the same, the entire measurement region is shrinked or enlarged such that: the measurement point intervals in the imaging mass analysis data of one (in this example, the sample A) of the samples are defined as a reference; and the measurement point intervals in the imaging mass analysis data of the other (in this example, the sample B) of the samples are equalized to the reference. At this time, because the entire measurement region is shrinked or enlarged, one measurement point interval on the sample does not change between before and after the region coupling, and there is no difference between the mass spectrum at each of the measurement points after the coupling and the mass spectrum at each of the measurement points before the coupling. Accordingly, in this case, intensity value correction required along with the equalization of measurement point intervals as described later is not necessary.

At this time, a rectangular region circumscribing a region formed by coupling the two measurement regions is newly set, and an intensity value of zero is inserted or a flag indicating that the measurement point is invalid is set to every blank measurement point formed as a result similarly to the above. In FIG. 3(*b*), for example, an intensity value of zero is inserted to each measurement point included in inside of a region surrounded by a dotted line.

Note that, in the case where optical microscopic observation images corresponding to the measurement regions exist, the measurement regions may be enlarged or shrinked as appropriate in accordance with the images, and may be then coupled to each other. In this case, the optical microscopic observation images may be similarly enlarged or shrinked and coupled to each other.

If the measurement point intervals of the two measurement regions to be combined are different from each other and if the designated mode is not the combining mode in which only spatial distribution conditions are focused but the combining mode in which spatial distribution conditions and spatial spreading sizes are focused (if No in Step S5), the following spatial correction is performed, and then the measurement regions are coupled to each other. The case where region coupling is performed on the imaging mass analysis data of the samples A and B shown in FIG. 4(*a*) is discussed here.

First, the measurement point intervals in the imaging mass analysis data of one (in this example, the sample A) of the samples are defined as a reference, and the measurement point intervals in the imaging mass analysis data of the other (in this example, the sample B) of the samples are redefined based on the reference. That is, unlike Step S6, the measurement point intervals on the sample are virtually changed between before and after the region coupling. Consequently, virtual measurement points are set at positions different from the positions of the actual measurement points within the measurement region on the sample B.

Because the virtual measurement points are not positions at which mass spectrum data is actually obtained, mass spectra at the virtual measurement points need to be respectively estimated from the intensity values of mass spectrum data obtained at the actual measurement points, in accordance with a deviation or difference in position between the actual measurement points and the virtual measurement points. Hence, in this case, one end (in this example, the upper left end in FIG. 4(*b*)) of the measurement region is defined as the origin, the intensity value corresponding to each mass-to-charge ratio value in the mass spectrum at each actual measurement point is defined as a function for association with X, Y coordinates of the measurement point, and correction using interpolation or extrapolation based on this function is performed, whereby the intensity values at the virtual measurement points are obtained. Briefly speaking, through two-dimensional interpolation or extrapolation based on the intensity values of the mass spectra at the actual measurement points located on two-dimensional X, Y coordinates, the intensity values of the mass spectra at the plurality of the virtual measurement points located on the same coordinates are calculated (Step S7).

Figure 4:
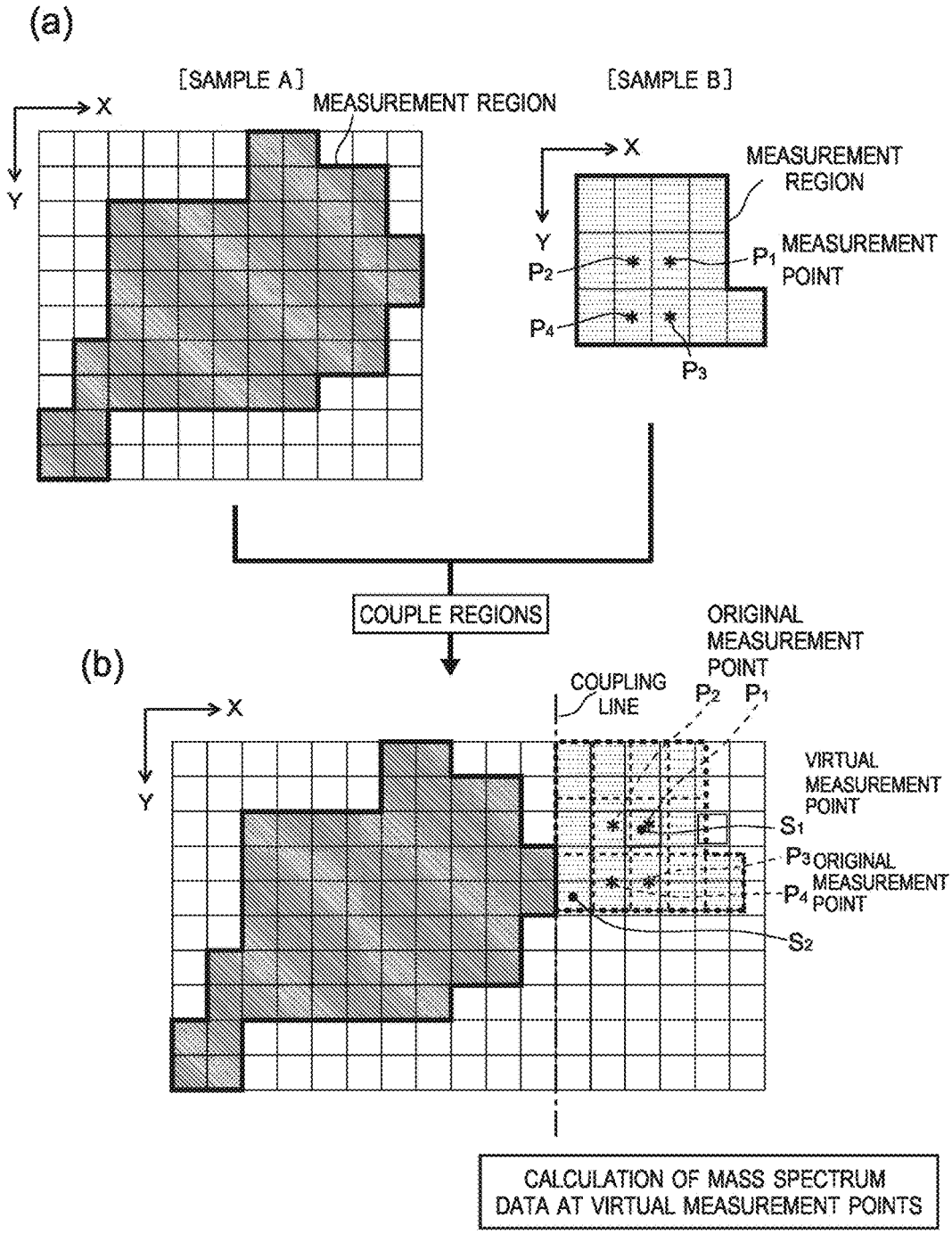
FIG. 4 is conceptual diagrams showing measurement region combining in the case of comparison of the spatial distribution and the spreading size of the substance in the imaging mass spectrometer system of the present embodiment.

For example, a measurement point $S_1$ in the measurement region on the sample B shown in FIG. 4(*b*) is a newly defined virtual measurement point, and is surrounded by actual measurement points $P_1$ to $P_4$. Hence, interpolation is performed for each mass-to-charge ratio, using the intensity values of the mass spectra at the actual measurement points, whereby the intensity value corresponding to the position of the virtual measurement point $S_1$ is obtained. Meanwhile, a measurement point $S_2$ is also a newly defined virtual measurement point, but actual measurement points at which a mass spectrum has been obtained exist only partially around the measurement point $S_2$. Hence, because correction using interpolation cannot be performed unlike the virtual measurement point $S_1$, in this case, extrapolation is performed based on the intensity values of mass spectra at adjacent measurement point before the redefinition, whereby the intensity value at the virtual measurement point $S_2$ is calculated. In this way, interpolation is used as much as possible, and extrapolation may be used if the interpolation cannot be used. Note that, because there is not any direct relationship between the imaging mass analysis data of the sample A and the imaging mass analysis data of the sample B as a matter of course, when the intensity values are obtained for one of the samples through such correction, the imaging mass analysis data of the other of the samples coupled is not regarded.

In the simplest case, a linear function may be used as a correction function for interpolation or extrapolation. In general, this is sufficient for practical use, but the use of a higher-order function, a spline function, and other such functions enables obtaining the mass spectrum at a virtual measurement point with higher accuracy.

If such intensity value calculation as described above is repeatedly performed for every mass-to-charge ratio, a new mass spectrum at one virtual measurement point is obtained. Moreover, a new mass spectrum is similarly obtained for every virtual measurement point. Consequently, a mass spectrum is obtained for every measurement point within the measurement regions that are coupled to each other so that the measurement point intervals are equalized to each other. Note that dummy data having an intensity value of zero is inserted to a blank portion in which actually no measurement point exists in the measurement region, similarly to the case of FIG. 3.

Note that, in FIG. 3 and FIG. 4, the two measurement regions are coupled to each other such that the upper left end of the measurement region on the sample B is continuous with the upper right end of the measurement region on the sample A, but the coupling position of the two measurement regions is not limited to it, and may be a position at which the two measurement regions are continuous with each other at any of their upper, lower, left, or right ends. If the coupling position is different, the X coordinate and the Y coordinate of each measurement point (micro measurement region) also change accordingly, but the absolute value of these coordinates does not have much importance, and hence no problem occurs in various types of processing to be described later.

Through the processing described above, the two measurement regions are spatially combined with each other. The imaging mass analysis data of the sample A and the imaging mass analysis data of the sample B are not necessarily the same as each other in the array of the mass-to-charge ratios of a mass spectrum. In view of this, subsequently, in order to equalize the arrays of the mass-to-charge ratios of mass spectra, the intensity values of mass spectra having different mass-to-charge ratio values are corrected (Step S8).

Figure 5:
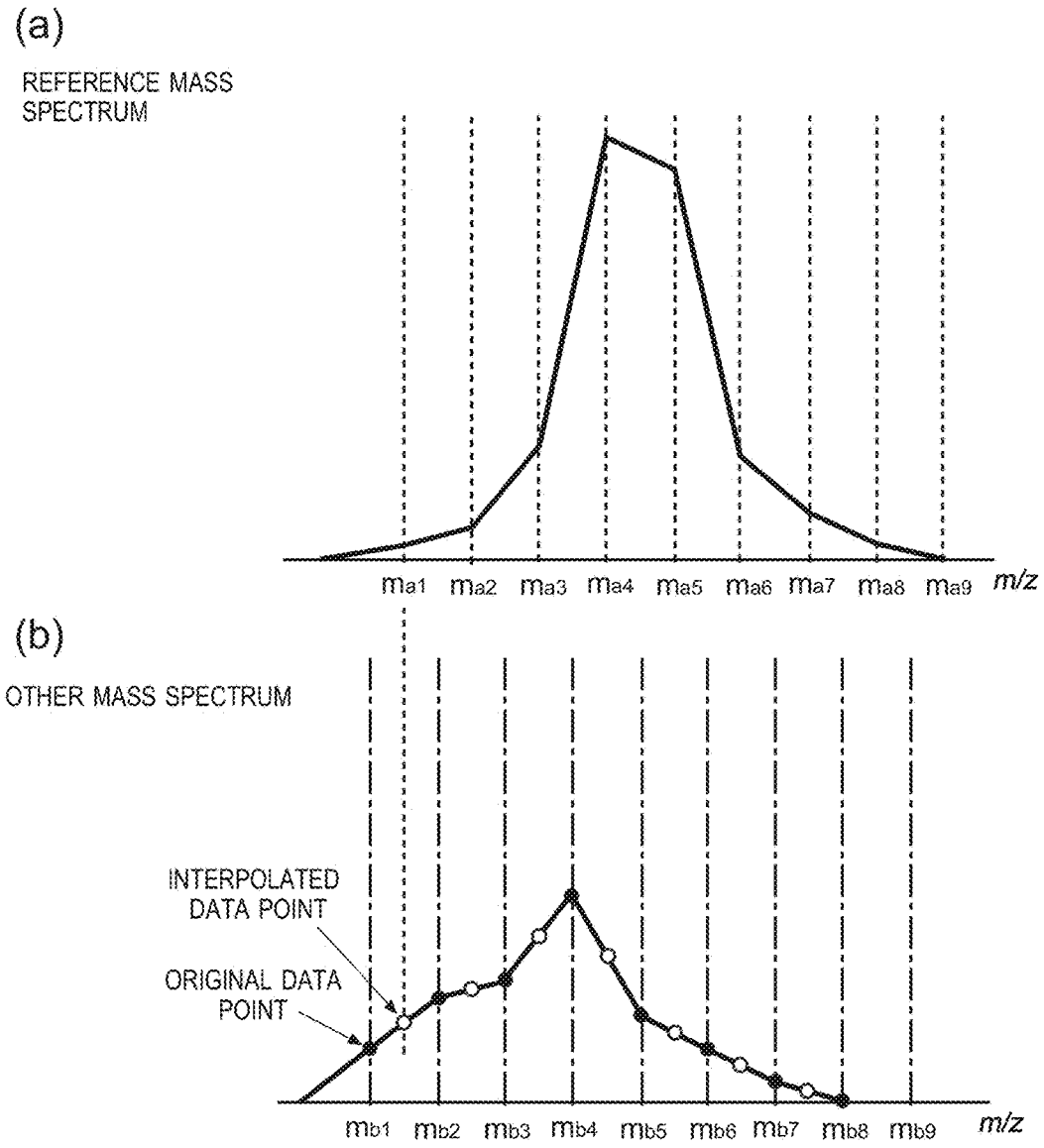
FIG. 5 is conceptual diagrams showing a correction process for equalizing the arrays of the mass-to-charge ratios of mass spectra in the imaging mass spectrometer system of the present embodiment.

First, a mass-to-charge ratio range common to the mass spectra of the two imaging mass analysis data to be coupled is obtained. In the case where the mass-to-charge ratio values at the data points (which is also referred to as "mass-to charge ratio points") constituting the mass spectrum included in each of imaging mass analysis data to be coupled and the mass-to-charge ratio intervals of the data points are different, as shown in FIG. 5, the mass-to-charge ratio values at the data points constituting the mass spectrum of one (in this example, the sample A) of the samples are defined as a reference, and the mass-to-charge ratio values at the data points constituting the mass spectrum of the other (in this example, the sample B) of the samples are redefined based on the reference. Then, in one mass spectrum, the intensity values corresponding to the redefined virtual mass-to-charge ratio values are obtained through interpolation or extrapolation based on actually obtained intensity values. If actually obtained intensity values respectively exist on both sides of a virtual mass-to-charge ratio value along a mass-to-charge ratio axis, the interpolation can be used. If an actually obtained intensity value exists on only one side of a virtual mass-to-charge ratio value, the extrapolation may be used. As a result, both of the mass-to-charge ratio ranges of the mass spectra of the imaging mass analysis data to be coupled and the mass-to-charge ratio values at the data points can be equalized, and the one-dimensional array of the mass-to-charge ratio values of the mass spectrum can be common for every measurement point.

Now, in FIG. 5, the simplest linear correction is discussed as an example. The intensity value corresponding to the position of $m/z=m_{a1}$ in a reference mass spectrum is obtained according to the following expression, using: $m/z=m_{b1}$, $m_{b2}$ adjacent to $m/z=m_{a1}$ on a mass-to-charge ratio axis in another mass spectrum to be corrected; and intensity values $I_{b1}$, $I_{b2}$ respectively corresponding to these m/z values.

$$I_{m1}=\{(I_{b2}-I_{b1})/(m_{b2}-m_{b1})\}(m_{a1}-m_{b1})+I_{b1}$$

Also for each intensity value in the mass spectrum to be corrected corresponding to $m/z=m_{an}$ (where n is 2, 3, . . . ) subsequent to $m/z=m_{a1}$, the intensity value corresponding to $m/z=m_{an}$ may be obtained according to the above expression through interpolation or extrapolation, based on the intensity values corresponding to the mass-to-charge ratio values adjacent to $m/z=m_{an}$ in the mass spectrum to be corrected.

In this way, such intensity value correction based on a difference in mass-to-charge ratio value at each data point constituting the mass spectrum is performed for each measurement point in the measurement region, whereby the arrays of the mass-to-charge ratio values (or the arrays of the mass-to-charge points) of the mass spectra at all the measurement points can be equalized. As a result, both of the measurement point intervals and the arrays of the mass-to-charge ratios of the mass spectra can be equalized, so that the combining of the imaging mass analysis data is completed.

Note that, in general, the arrays of the mass-to-charge ratios of mass spectra at all measurement points are common in imaging mass analysis data of one sample, but the arrays of the mass-to-charge ratios of the mass spectra may be different for each measurement point even in imaging mass analysis data of one sample, in some cases. This applies to, for example, the case where measurement with a high mass resolving power is performed on a specific region, typically, a region of interest in the measurement region whereas measurement with a relatively low mass resolving power is performed on the other portion than the region of interest in the measurement region.

In the case where the arrays of the mass-to-charge ratios of the mass spectra are different in the imaging mass analysis data of one sample as described above, the mass-to-charge ratio values at the data points constituting the mass spectrum at one measurement point are defined as a reference, and the mass-to-charge ratio values at the data points constituting the mass spectra at other measurement points are redefined based on the references. Then, as shown in FIG. 5, the mass-to-charge ratio values at the data points constituting one mass spectrum are defined as references, and the intensity values corresponding to the same mass-to-charge ratio values of other mass spectra are obtained based on the reference through interpolation or extrapolation. In this way, the mass-to-charge ratio values at the data points constituting the mass spectrum at each measurement point are equalized in the imaging mass analysis data of the one sample, so that the resultant imaging mass analysis data can be treated as data having common arrays of the mass-to-charge ratios and the arrays of the intensity values for each measurement point. Such processing is advantageous regardless of whether or not to combine a plurality of measurement regions, that is, such processing is also advantageous to, for example, the case where a mass analysis result image or a peak matrix for a statistical analysis is created based on the imaging mass analysis data of one sample.

In the case where the imaging mass analysis data having the arrays of the mass-to-charge ratios of mass spectra different for each measurement point are combined with each other or where imaging mass analysis data having different arrays of the mass-to-charge ratios is combined with imaging mass analysis data having common arrays of the mass-to-charge ratios, the mass-to-charge ratio values at the data points constituting the mass spectrum at one specific measurement point are defined as references, and the mass-to-charge ratio values at the data points constituting the mass spectra at all the measurement points other than the reference are redefined based on the references. Then, as shown in FIG. 5, the mass-to-charge ratio values at the data points constituting one mass spectrum are defined as a reference, and the intensity values corresponding to the same mass-to-charge ratio values of other mass spectra are obtained based on the reference through interpolation or extrapolation. As a result, the imaging mass analysis data to be combined can be treated as data having common mass-to-charge ratio arrays and the arrays of the intensity values for each measurement point.

Any of: the redefinition of measurement points and the intensity value correction process for coupling measurement regions; and the intensity value correction process for equalizing the arrays of the mass-to-charge ratios of the mass spectra may be performed first. The imaging mass analysis data thus combined is once stored into the uncompressed imaging mass analysis data memory area 40 of the external memory device 4.

Note that, in the case of data having equal measurement point intervals, the data can be combined with each other without performing the redefinition of measurement point intervals and the enlargement/shrinkage of one of the data for equalizing the measurement point intervals. Further, it is obvious that, in the case where the data to be combined are equal in the mass-to-charge ratio values at the data points constituting the mass spectra at all the measurement points, the data can be combined with each other without performing the intensity value correction process for equalizing the arrays of the mass-to-charge ratios. In the case where the data that are equal in any of the measurement point intervals and the arrays of the mass-to-charge ratios are combined with each other, only any one of the measurement point intervals and the arrays of the mass-to-charge ratios may be corrected.

After the imaging mass analysis data is once stored into the uncompressed imaging mass analysis data memory area 40 of the external memory device 4, the data compressor 23 sequentially reads, out of the external memory device 4, mass spectrum data for each measurement point with regard to the imaging mass analysis data combined as described above, and performs data compression for each measurement point according to a data compression algorithm to be described later. Further, the index creator 25 creates such an index as described later for each measurement point, using the mass spectrum data (original mass spectrum data) and the compressed data. Further, the normalization coefficient calculator 26 calculates a TIC normalization coefficient at each measurement point in such a manner as described later. Moreover, the peak matrix creator 27 calculates a peak matrix for a statistical analysis in such a manner as described later. The compressed data, the index, the TIC normalization coefficient, and the peak matrix thus calculated for the mass spectrum data are respectively stored into the compressed data memory area 211, an index memory area 212, a normalization coefficient memory area 213, and a peak matrix memory area 214 of the main memory 21.

Moreover, the mass spectrum creator 29 sums the mass spectrum data at all the measurement points for each mass-to-charge ratio, and divides each summed value by the total number of the measurement points, and obtain an average mass spectrum. Then, the mass spectrum creator 29 stores the average mass spectrum into a spectrum memory area 216 of the main memory 21, and displays the average mass spectrum onto the screen of the display unit 6 through the display processor 32. The displayed average mass spectrum enables the operator to schematically understand the ion intensity at which mass-to-charge ratio is high (the amount of substance having which mass is large) as a whole.

[Details of Compression Process for Mass Spectrum Data]

The compression process for mass spectrum data in the system of the present embodiment is described with reference to FIG. 6, and FIG. 7. Note that this data compression method is disclosed in Patent Literature 1.

Imaging mass analysis data collected from one sample includes: a one-dimensional array data of mass-to-charge ratio values common to all measurement points; and one-dimensional array data of ion intensity values of a mass spectrum at each measurement point. In the case where the imaging mass spectrometer unit 1 includes a TOFMS, one-dimensional array data of time-of-flight values can also be used instead of one-dimensional array data of mass-to-charge ratio values. Description is given here by taking an example case of compressing one-dimensional array data of an ion intensity values extracted from such a mass spectrum as shown in FIG. 6(*a*).

Note that it is assumed that one ion intensity value corresponding to a given mass-to-charge ratio is two-byte (16-bit) data (the HEX notation is hereinafter used to show the data values, and these values will be enclosed in a pair of curly brackets, { }, when they appear in this specification). It is also assumed that it is determined prior to the data compression whether or not each intensity value is less than a predetermined noise level and that an intensity value less than the predetermined noise level is replaced with zero. If such preprocessing is performed, the intensity value of zero is likely to consecutively occur in the other portions than significant peaks.

Figure 6:
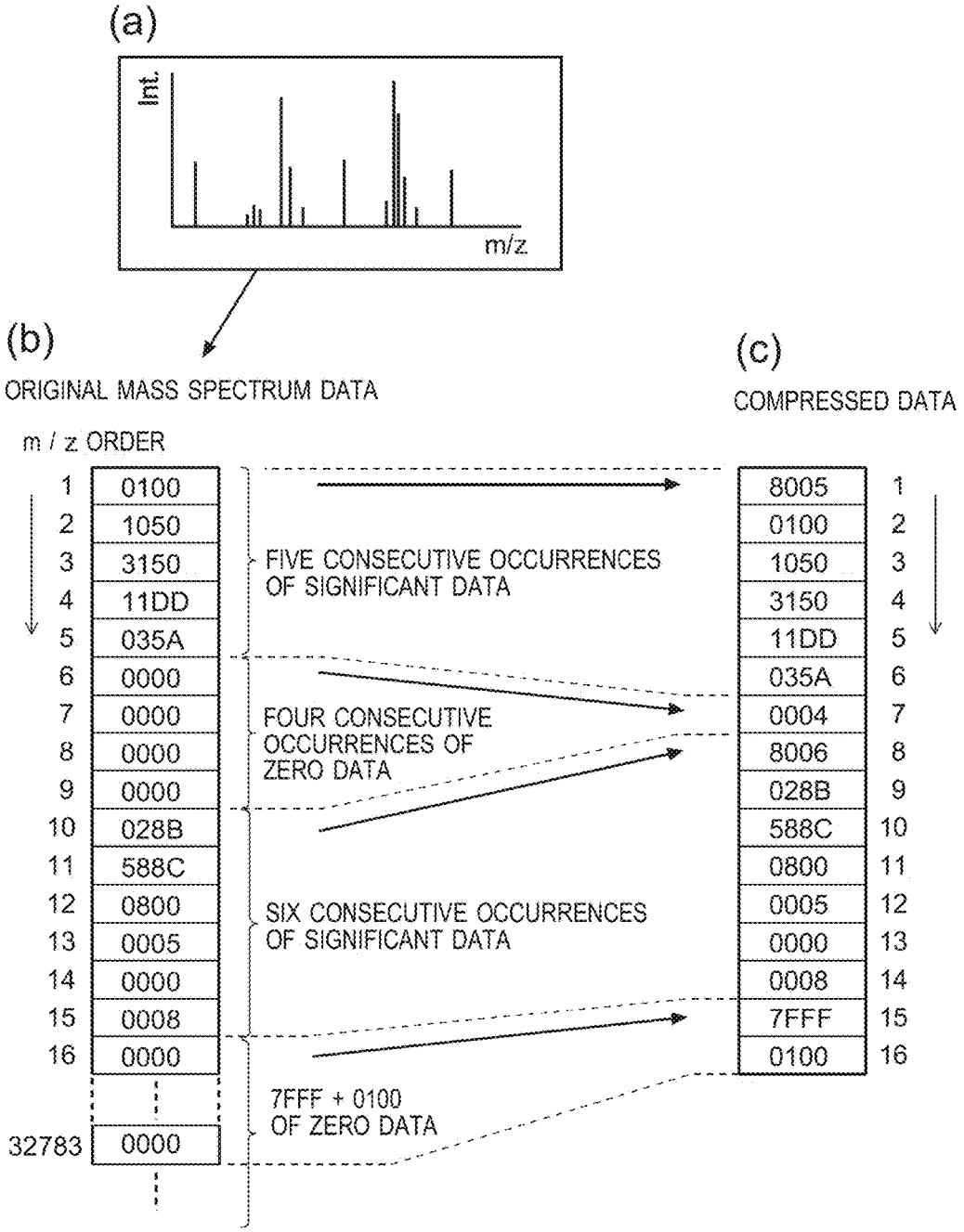
FIG. 6 is conceptual diagrams showing a data compression example in the imaging mass spectrometer system of the present embodiment.

Intensity value checking is performed on such a one-dimensional array of ion intensity values as shown in FIG. 6(*b*) in ascending order of their mass-to-charge ratios (in order as indicated by a downward arrow in FIG. 6(*b*)). In the case where the intensity value of zero (expressed as {0000} in FIG. 6, and FIG. 7) consecutively occurs two or more times, the zero sequence is replaced with a value indicating the number of consecutive occurrences of zeros. In the present system, the maximum number of consecutive occurrences of zeros that can be treated at one time is 32,767. In the case where the zero sequence exceeds this length, the first 32,767 zeroes are replaced with {7FFF}, and the number of remaining zeroes is stored in the next row of the array of the compressed data.

Meanwhile, in the case where a non-zero intensity value consecutively occurs one or more times, a value indicating the number of consecutive occurrences of the non-zero intensity values is stored in the first row of the non-zero sequence in the array of the compressed data, after which the intensity values are sequentially stored as they are. Note that the upper limit of the number of consecutive occurrences, 32,767, also applies to this case. For a sequence that exceeds this length, the same algorithm is repeatedly used to store the number of intensity values remaining in the sequence. Further, when the value indicating the number of consecutive occurrences of the non-zero intensity values is stored in the first row of the non-zero sequence in the array of the compressed data, the most significant bit (MSB) of the two-byte data is set to "1". This means that the numerical value indicating the number of consecutive occurrences is actually represented by 15 bits of the two-byte (16-bit) data except for the MSB. Accordingly, in the case where the number of consecutive occurrences is equal to or more than 32,768 ($=2^{15}$), the numerical value indicating the number of consecutive occurrences is larger than {7FFF}, and hence it can be immediately known that the two-byte data indicates a sequence of non-zero intensity data values. The actual number of consecutive occurrences can be calculated by removing the MSB from the 16-bit values in the case of the binary notation, or by subtracting {8000} from the value of the two-byte data in the case of the HEX notation.

In the example of FIG. 6(*b*), the one-dimensional array of ion intensity values starts with five significant, non-zero data values. Accordingly, a value of {8005}, with the MSB being set to "1" and the other bits indicating the number of consecutive occurrences, i.e. 5, is stored in the first row of the non-zero sequence in the array of the compressed data shown in FIG. 6(*c*), after which the five data values in the array of the original mass spectrum data are copied to the array of the compressed data as they are. Thus, five consecutive pieces of data in the array of the original mass spectrum data correspond to six consecutive pieces of data in the array of the compressed data. Subsequently, four pieces of data having an intensity value of zero consecutively occur in the array of the original mass spectrum data. In the array of the compressed data, this zero-data sequence is represented with one piece of data having a value of {0004}. According to such coding rules, the one-dimensional array of ion intensity values is converted into the array of the compressed data.

Figure 7:
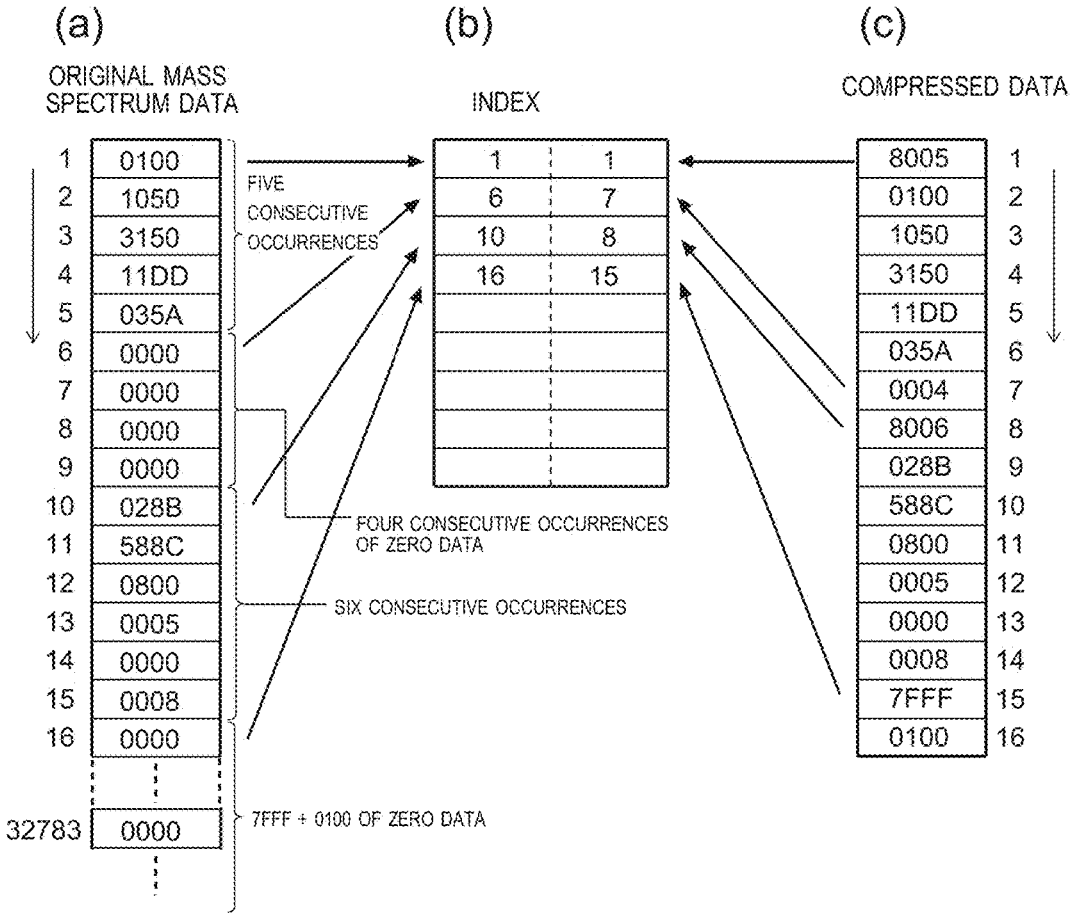
FIG. 7 is conceptual diagrams showing an index information creation example in the imaging mass spectrometer system of the present embodiment.

Meanwhile, an index shown in FIG. 7(*b*) is a set of information representing the correspondence relationship between the positions in the array of the original mass spectrum data and the positions in the array of the compressed data. A specific example of the index is a list of position correspondence relationship items, in which: the start position of a portion in which the intensity value of zero consecutively occurs two or more times in the array of the original mass spectrum data is paired with the corresponding position in the array of the compressed data; the start position of a sequence of data having significant intensity values in the array of the original mass spectrum data is paired with the corresponding position in the array of the compressed data; and each pair forms one row. For example, the sixth element in the array of the original mass spectrum data shown in FIG. 7(*a*) is paired with the seventh element in the array of the compressed data shown in FIG. 7(*c*), and the tenth element in the array of the original mass spectrum data shown in FIG. 7(*a*) is paired with the eighth element in the array of the compressed data shown in FIG. 7(*c*). The procedures for creating this index do not fall within the spirit of the present invention, and hence the description is omitted. This index can be easily created according to the technique disclosed in Patent Literature 1. Although this index is not essential to restore the original spectrum data from the compressed data, the use of this index enables high-speed calculation of the intensity value corresponding to an arbitrary mass-to-charge ratio.

Note that the technique for data compression encoding is not limited to the above-mentioned method disclosed in Patent Literature 1, and the methods disclosed in Patent Literatures 2 and 3 and various other methods can be used.

In actuality, the time required to compress one mass spectrum data is sufficiently shorter than the time required to move the sample stage for each measurement point and perform a mass analysis while in the imaging mass spectrometer unit 1, and the load that is put on the CPU by processing in the data collector 20 during the measurement is low. Hence, during the measurement, the data compressor 23 may compress the obtained mass spectrum data, and may store the compressed imaging mass analysis data into a compressed imaging data memory area (not shown) of the external memory device 4. Moreover, during the measurement, the index creator 25 may create an index, and may store the data of the created index into the external memory device 4. That is, the compression of imaging mass analysis data and the creation of an index do not need to be performed in a batch processing mode, and can be performed in nearly real time during the measurement.

As described above, in the case where the statistical analysis for comparing the plurality of imaging mass analysis data compressed during the measurement and the display of the mass analysis result images are performed, the process for combining the imaging mass analysis data of the plurality of samples to be compared so that the imaging mass analysis data can be treated as if they were one data is performed prior to reading the data to be processed. In this case, the compressed mass spectrum at each measurement point of the data to be compared is once decompressed, and the above-mentioned combining process for the imaging mass analysis data is performed.

In the combining process, the compressed mass spectra at all the measurement points are not decompressed at a time, but only the mass spectra at the measurement points to be subjected to the combining process are sequentially decompressed, and combined portions are sequentially compressed again to be stored into the external memory device 4. Alternatively, the combined portions can be stored in an uncompressed state (that is, can be stored as uncompressed data) into the external memory device 4. For example, in the case of calculating the mass spectrum at the virtual measurement point $S_1$ shown in FIG. 4(*b*), the linear correction requires only the mass spectra at the original measurement points $P_1$ to $P_4$, and hence only the required mass spectra are decompressed. If the mass spectrum at the measurement point $S_1$ is obtained, the obtained mass spectrum is compressed again to be stored into the external memory device 4. In the case of correcting the positions of the data points constituting the mass spectrum as shown in FIG. 5, if the mass-to-charge ratio values at the data points of the reference mass spectrum are determined, the mass spectrum is then decompressed for each measurement point, the intensity values corresponding to the mass-to-charge ratio values as the reference are obtained through interpolation or extrapolation, and the new corrected mass spectrum is compressed again to be stored into the external memory device 4. This can reduce the amount of use of the memory area during the combining process.

The imaging mass analysis data combined and compressed as described above is read onto the compressed data memory area 211 of the main memory 21 without passing through the data compressor 23, and the subsequent processing is performed. When the combined and compressed imaging mass analysis data is stored into the main memory 21, the index creator 25 creates again an index corresponding to the combined data, and stores the index into the index memory area 212 of the main memory 21.

When the compression process is performed during the measurement, that is, while collecting the mass spectrum data, and only minimum necessary data is decompressed for the combining process, it can reduce the amount of use of the memory area. Then, the entire processing during the data collection, the combining process, and the statistical analysis can be performed while the necessary data is stored in the main memory 21, without the need to store the data in the external memory device 4.

[Calculation of TIC Normalization Coefficient]

Figure 8:
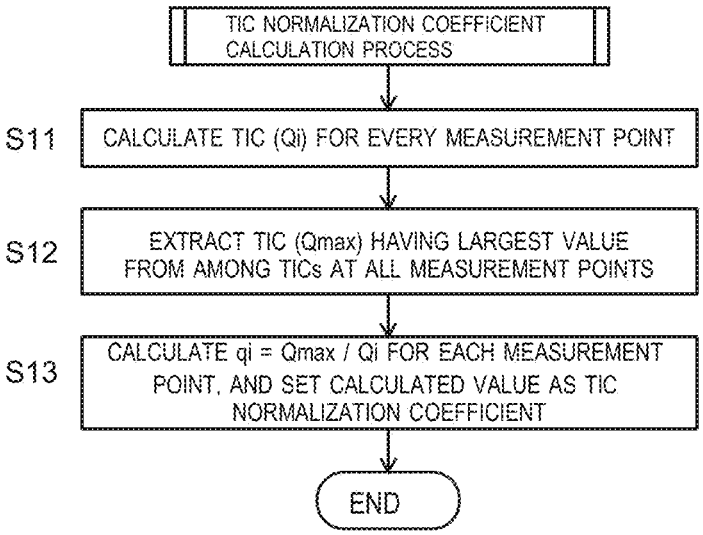
FIG. 8 is a flowchart showing a TIC normalization coefficient calculation process in the imaging mass spectrometer system of the present embodiment.

As described above, in TIC normalization, the ion intensity values in each mass spectrum are normalized so that the TIC, which is the sum of all the ion intensity values that appear in one mass spectrum, is equalized for every measurement point. The TIC normalization coefficient is a normalization coefficient that is calculated for such normalization for each measurement point. FIG. 8 is a detailed flowchart showing the TIC normalization coefficient calculation process.

That is, the TIC is first calculated for every measurement point by summing all the ion intensity values that appear in the mass spectrum over a predetermined mass-to-charge ratio range. It is assumed here that the TIC at the $i^{th}$ (i=1, 2, . . . , N assuming that the total number of measurement points is N) measurement point is Qi (Step S11). Subsequently, the TIC having the largest value is obtained by comparing the values of TICs (that is, Q1 to QN) at all the measurement points with each other, and the obtained TIC is set as Qmax (Step S12). Then, qi=Qmax/Qi is calculated for each measurement point, and this qi is set as the TIC normalization coefficient at each measurement point (Step S13). The TIC normalization coefficient thus obtained may be stored into the normalization coefficient memory area 213 of the main memory 21.

Because the value of TIC is the sum of all the ion intensity values that appear in one mass spectrum, this value is uniquely determined, unlike XIC. Hence, the value of TIC may be calculated in advance using the idle capacity of the CPU during the measurement. In this case, each time the data collector 20 obtains the mass spectrum data at each measurement point during the measurement, the TIC is calculated by summing all the ion intensity values that appear in the mass spectrum over a predetermined mass-to-charge ratio range, and the calculated value is stored into the external memory device 4 together with position information of each measurement point.

After the end of the measurement, the value of TIC is read out of the external memory device 4 as needed, and is stored into a TIC memory area (not shown) created in the main memory 21 of the data processor 2. After that, the TIC normalization coefficient calculation process (see FIG. 8) may be performed as needed, and the obtained TIC normalization coefficient may be stored into the normalization coefficient memory area 213 of the main memory 21.

[Creation of Peak Matrix for Statistical Analysis]

A peak matrix used for a statistical analysis includes: a one-dimensional array of one mass-to-charge ratio values common to all measurement points; and a one-dimensional arrays of ion intensity values respectively corresponding to the measurement points. The one-dimensional array of mass-to-charge ratio values is created by: selecting peaks from the average mass spectrum of all the measurement points or the maximum intensity mass spectrum of all the measurement points (the mass spectrum obtained by extracting peaks that are maximum intensities for each mass-to-charge ratio in the mass spectra at all the measurement points and reconstructing the extracted peaks as a spectrum); and listing the respective mass-to-charge ratio values of the peaks. If this array of mass-to-charge ratio values common to all the measurement points is obtained, the ion intensity values respectively corresponding to the mass-to-charge ratio values in the mass-to-charge ratio value array are obtained and listed for the mass spectrum at each measurement point. The list of the ion intensity values thus obtained for each measurement point is rewritten into a matrix form, whereby the peak matrix is obtained.

Note that even spectrum peaks for the same substance may be slightly different in mass-to-charge ratio value, due to a mass error or other factors in the imaging mass spectrometer unit 1. Hence, in order to create a peak matrix in consideration of such a mass error, a mass-to-charge ratio range may be set so that an appropriate margin is given to each of the mass-to-charge ratio values in the array of mass-to-charge ratio values, the highest ion intensity may be extracted within the set mass-to-charge ratio range in the mass spectrum at each measurement point, and the extracted ion intensity may be listed as the ion intensity value corresponding to the center of the mass-to-charge ratio value at.

In this way, without the need to wait for a specific instruction by the operator such as an instruction to display a mass analysis result image, the compressed data corresponding to the mass spectrum data at each measurement point, the index associated with the compressed data, the TIC normalization coefficient at each measurement point, and the peak matrix for the statistical analysis are automatically stored into the main memory 21. The average mass spectrum obtained by averaging the mass spectrum data at all the measurement points is displayed on the screen of the display unit 6, and the next instruction by the operator is waited for in this state.

[Creation and Display of Unnormalized Mass Analysis Result Image]

In the case where the operator focuses attention on a specific substance among various substances included in a sample, the mass-to-charge ratio or mass-to-charge ratio range of the observation target is known to the operator. Even in the case where such prior information regarding the mass-to-charge ratio is not provided, the operator visually checks the average mass spectrum displayed on the screen of the display unit 6 as described above, to thereby identify the mass-to-charge ratio or mass-to-charge ratio range of interest. In the case where the operator desires to check a mass analysis result image that has not been subjected to ion intensity value normalization for the mass-to-charge ratio or mass-to-charge ratio range on which the operator focuses attention or in which the operator is interested, the operator designates the mass-to-charge ratio or the mass-to-charge ratio range through the operation unit 5, and gives an instruction to display the unnormalized mass analysis result image.

Upon the reception of this instruction, the data decompressor 24 refers to the index that corresponds to each measurement point and is stored in the index memory area 212 of the main memory 21, and reads minimum necessary compressed data corresponding to the designated mass-to-charge ratio or mass-to-charge ratio range, from the compressed data of the measurement points stored in the compressed data memory area 211 of the main memory 21. Then, the ion intensity values at each measurement point in the designated mass-to-charge ratio or mass-to-charge ratio range are restored by performing a decoding process for decompressing the read compressed data. As described above, in the case of using lossless run-length encoding for the data compression, the intensity values that are completely the same as those of the original mass spectrum data are restored by decoding the compressed data.

The image creator 28 determines a display color corresponding to each intensity value, and two-dimensionally arranges pixels provided with the display colors respectively corresponding to the intensity values obtained for each measurement point, to thereby create a mass analysis result image in the designated mass-to-charge ratio. Then, the mass analysis result image is drawn on the screen of the display unit 6 through the display processor 32. In this way, the mass analysis result image showing the two-dimensional distribution of a substance having the designated mass-to-charge ratio is created and displayed as shown in an upper part of FIG. 13 (in which the mass-to-charge ratio is $M_1$). In the case where the display of a mass analysis result image is not a single mass-to-charge ratio but a mass-to-charge ratio range is designated, the image creator 28 obtains a summed intensity values by summing the ion intensity values respectively corresponding to the plurality of mass-to-charge ratios within the designated mass-to-charge ratio range, determines a display color corresponding to each of the summed intensity values, and two-dimensionally arranges pixels provided with the corresponding display colors, to thereby create a mass analysis result image. Note that mass analysis result image data that is such a two-dimensional array of ion intensity values or summed intensity values for each measurement point is stored into an image memory area 215 of the main memory 21 in association with the mass-to-charge ratio or the mass-to-charge ratio range.

[Creation and Display of Unnormalized Mass Spectrum]

As described above, an average mass spectrum of all measurement points is automatically created and displayed on the display unit 6, and a region in which the operator is interested (that is, a region of interest) in a measurement range on a sample displayed as a mass analysis result image is significantly limited in many cases. In view of this, the present system is provided with the following function. That is, if the operator designates, through the operation unit 5, a region of interest (ROI) having an appropriate size and an appropriate shape on, for example, a mass analysis result image displayed on the display unit 6 or a microscopic observation image drawn based on microscopic observation image data, the average mass spectrum of only the measurement points included in the region of interest is created and displayed on the display unit 6.

That is, if the operator designates the region of interest through the operation unit 5, the data decompressor 24 refers to the index that corresponds to each measurement point and is stored in the index memory area 212 of the main memory 21, and reads compressed data of only the measurement points included in the region of interest, from the compressed data of the measurement points stored in the compressed data memory area 211 of the main memory 21. Then, the mass spectrum data of each measurement point included in the designated region of interest is restored by decompressing the read compressed data. Subsequently, the mass spectrum creator 29 sums the restored mass spectrum data of the measurement points for each mass-to-charge ratio, and divides each summed value by the number of the measurement points, to thereby obtain the average mass spectrum for the region of interest. Then, the average mass spectrum is stored into the spectrum memory area 216 of the main memory 21 in association with information for identifying the region of interest, and is displayed on the screen of the display unit 6 through the display processor 32.

[Calculation of XIC Normalization Coefficient]

Figure 9:
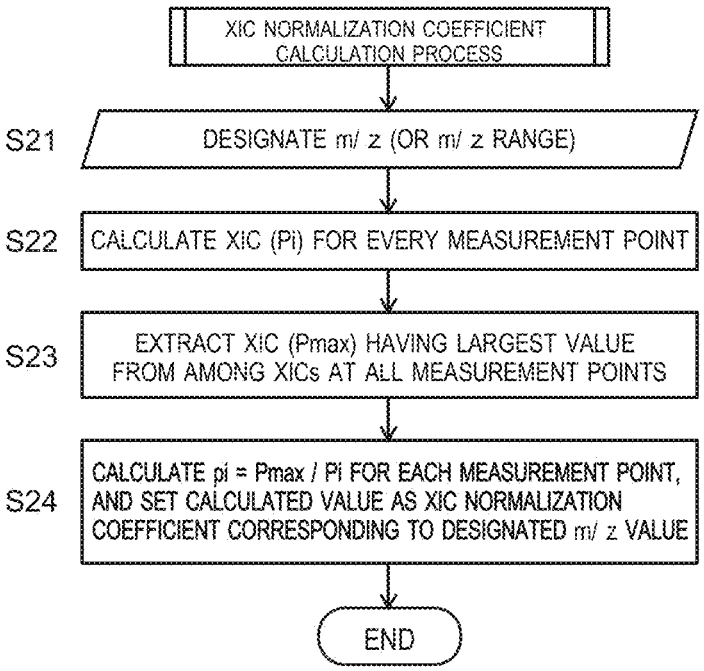
FIG. 9 is a flowchart showing an XIC normalization coefficient calculation process in the imaging mass spectrometer system of the present embodiment.

As described above, in XIC normalization, the ion intensity values in each mass spectrum are normalized so that the XIC, which is an ion intensity value in a specific mass-to-charge ratio in one mass spectrum, is equalized for every measurement point. FIG. 9 is a detailed flowchart of the XIC normalization coefficient calculation process.

If a mass-to-charge ratio or a mass-to-charge ratio range as a condition of the XIC normalization is designated by the operator (Step S21), the data decompressor 24 refers to the index that corresponds to each measurement point and is stored in the index memory area 212 of the main memory 21, and reads minimum necessary compressed data corresponding to the designated mass-to-charge ratio or mass-to-charge ratio range, from the compressed data of the measurement points stored in the compressed data memory area 211 of the main memory 21. Then, the ion intensity values in the specific mass-to-charge ratio or mass-to-charge ratio range at each measurement point are restored by decompressing the read compressed data. It is assumed here that the XIC in the designated mass-to-charge ratio at the $i^{th}$ (the definition of i is the same as the above) measurement point is Pi (Step S22). Note that, in the case where not a specific mass-to-charge ratio but a mass-to-charge ratio range is designated, the summed value of the ion intensities respectively corresponding to the mass-to-charge ratios included in the designated range may be calculated as Pi.

Subsequently, the XIC having the largest value is obtained by comparing the values of XICs (that is, P1 to PN) at all the measurement points with each other, and the obtained XIC is set as Pmax (Step S23). Then, pi=Pmax/Pi is calculated for each measurement point, and this pi is set as the XIC normalization coefficient corresponding to the designated mass-to-charge ratio or mass-to-charge ratio range (Step S24). The XIC normalization coefficient thus obtained for each measurement point is stored into the normalization coefficient memory area 213 of the main memory 21 in association with the mass-to-charge ratio or the mass-to-charge ratio range. As described above, XIC normalization coefficients are different for each mass-to-charge ratio or mass-to-charge ratio range, unlike TIC normalization coefficients which do not depend on mass-to-charge ratios. Hence, each time a different mass-to-charge ratio or mass-to-charge ratio range is designated by the operator, a new XIC normalization coefficient is calculated by performing the processing shown in FIG. 9, and is stored into the normalization coefficient memory area 213 of the main memory 21 in association with the mass-to-charge ratio or the mass-to-charge ratio range.

[Creation and Display of Normalized Mass Analysis Result Image]

In the case where an instruction to create and display a TIC-normalized or XIC-normalized mass analysis result image is given by the operator, there are two methods for the creation. Note that, in the case where XIC normalization is performed and where the normalization coefficient is not stored in the normalization coefficient memory area 213, the XIC normalization coefficient is obtained in advance in such a manner as described above.

(1) the Case where an Unnormalized Mass Analysis Result Image Exists

In the case where unnormalized mass analysis result image data in a designated mass-to-charge ratio or mass-to-charge ratio range is already stored in the image memory area 215, the normalization processor 30 reads the mass analysis result image data (that is, the ion intensity values at each measurement point) out of the image memory area 215, and reads the XIC normalization coefficient corresponding to the designated mass-to-charge ratio or mass-to-charge ratio range out of the normalization coefficient memory area 213. Then, the normalization processor 30 multiplies each read ion intensity value by the XIC normalization coefficient at the corresponding measurement point, to thereby modify the intensity value. The image creator 28 creates a mass analysis result image based on the intensity value modified using the XIC normalization coefficient, and displays the mass analysis result image on the screen of the display unit 6 through the display processor 32. In this case, only the process for multiplying the intensity value at each measurement point by the normalization coefficient is required, and hence the normalized mass analysis result image can be displayed at extremely high speed.

(2) the Case where No Unnormalized Mass Analysis Result Image Exists

Figure 10:
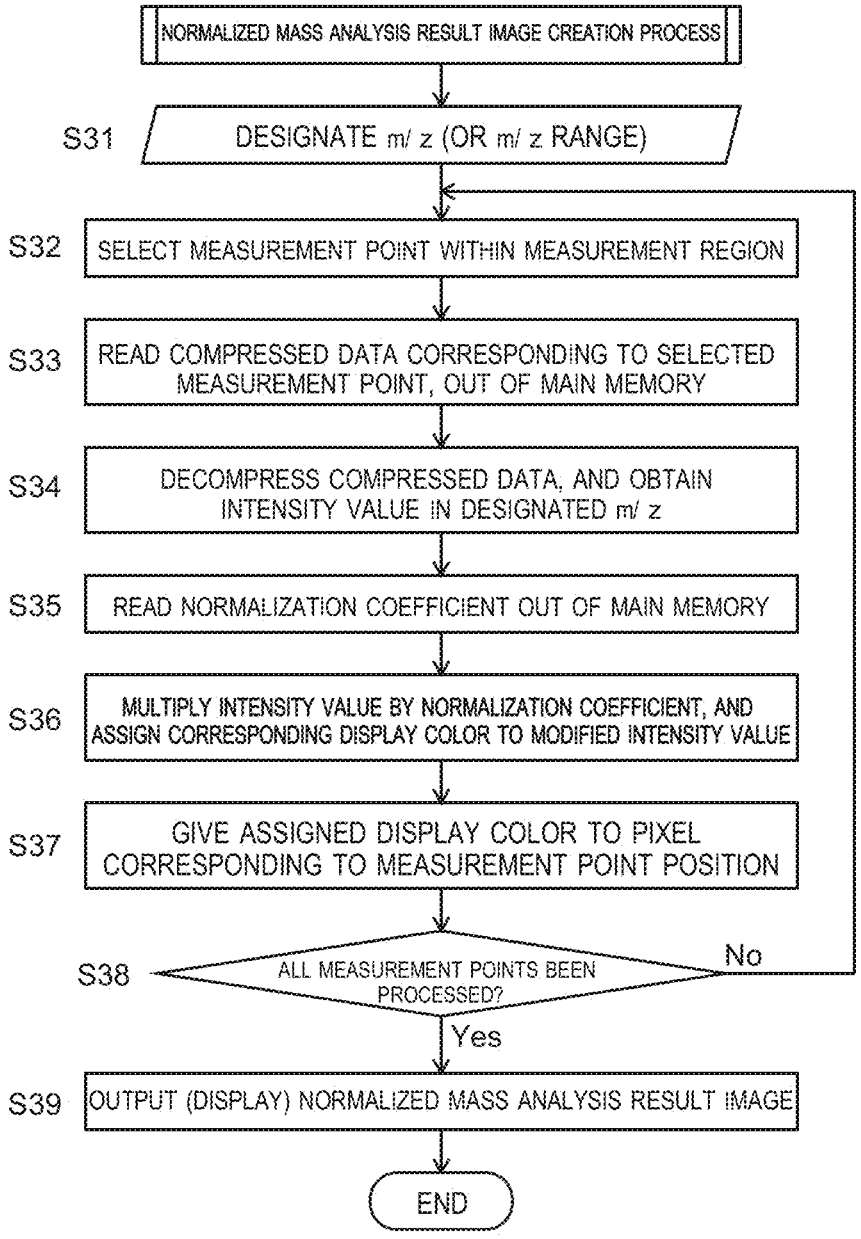
FIG. 10 is a flowchart showing a creation and display process of a normalized mass analysis result image in the imaging mass spectrometer system of the present embodiment.

In the case where unnormalized mass analysis result image data in a designated mass-to-charge ratio or mass-to-charge ratio range is not stored in the image memory area 215, it is necessary to form a mass analysis result image from compressed data and then normalize the formed image. A flowchart of this processing is shown in FIG. 10.

If the operator designates a mass-to-charge ratio or a mass-to-charge ratio range through the operation unit 5 (Step S31), the data decompressor 24 selects one measurement point within a measurement region (Step S32), refers to the index that corresponds to the selected measurement point and is stored in the index memory area 212 of the main memory 21, and reads minimum necessary compressed data corresponding to the designated mass-to-charge ratio or mass-to-charge ratio range, from the compressed data of the selected measurement point stored in the compressed data memory area 211 of the main memory 21 (Step S33). Then, the ion intensity values at the selected measurement point in the designated mass-to-charge ratio or mass-to-charge ratio range are restored by performing a decoding process for decompressing the read compressed data (Step S34).

Subsequently, the normalization processor 30 reads the TIC normalization coefficient or the XIC normalization coefficient that corresponds to the selected measurement point and is stored in the normalization coefficient memory area 213 of the main memory 21 (Step S35), and multiplies each intensity value which is restored in Step S34 by the read normalization coefficient, to thereby modify the intensity value. The image creator 28 assigns a display color to the modified intensity value, and determines the display color of a pixel corresponding to the measurement point (Steps S36 and S37). If there is an unprocessed measurement point within the measurement region, the processing returns from Step S38 to Step S32, and Step S33 to Step S37 are performed on the unprocessed measurement point. If the display colors of the pixels respectively corresponding to all the measurement points are determined through the repetition of such processing, the normalized mass analysis result image is displayed on the screen of the display unit 6 through the display processor 32 (Step S39).

Note that, in the case where a plurality of mass analysis result images whose normalization conditions are different from each other are simultaneously displayed for comparison, the two-dimensional array of intensity values that have been normalized under a given normalization condition may be once held in the image memory area 215 of the main memory 21, and such processing may be repeated. Then, if the mass analysis result images to be displayed are prepared for all the normalization conditions, the prepared images may be simultaneously displayed on the screen of the display unit 6.

[Creation and Display of Normalized Average (or Maximum Intensity) Mass Spectrum]

Figure 11:
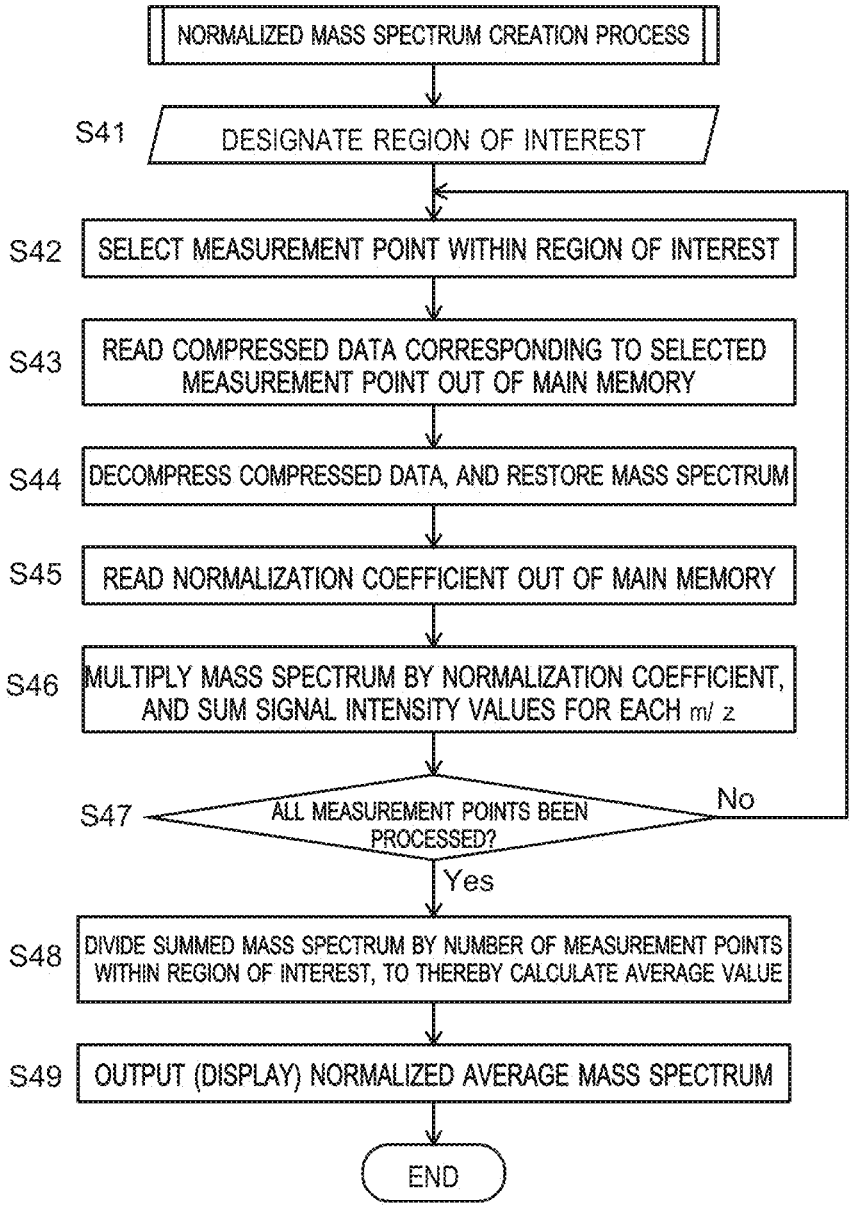
FIG. 11 is a flowchart showing a creation and display process of a normalized mass spectrum in the imaging mass spectrometer system of the present embodiment.

A flowchart of a process for creating and displaying a normalized average mass spectrum (or maximum intensity mass spectrum) of measurement points included in an entire measurement region or a region of interest is shown in FIG. 11.

If the operator designates, for example, a region of interest through the operation unit 5 (Step S41), the data decompressor 24 selects one measurement point within the region of interest (Step S42), refers to the index that corresponds to the selected measurement point and is stored in the index memory area 212 of the main memory 21, and reads the compressed data of the selected measurement point stored in the compressed data memory area 211 of the main memory 21 (Step S43). Then, the ion intensity values at the selected measurement point are restored by performing a decoding process for decompressing the read compressed data (Step S44).

Subsequently, the normalization processor 30 reads the TIC normalization coefficient or the XIC normalization coefficient that corresponds to the selected measurement point and is stored in the normalization coefficient memory area 213 of the main memory 21 (Step S45), and multiplies each of the intensity values over the entire mass-to-charge ratio range that are restored in Step S44, by the read normalization coefficient, to thereby modify the intensity values. The mass spectrum creator 29 sums the modified intensity values for each mass-to-charge ratio (Step S46). If there is an unprocessed measurement point within the measurement region, the processing returns from Step S47 to Step S42, and Step S43 to Step S46 are performed on the unprocessed measurement point. If the summed values of the normalized ion intensities for each mass-to-charge ratio at all the measurement points within the region of interest are obtained through the repetition of such processing, the mass spectrum creator 29 divides each summed value by the number of the measurement points within the region of interest, to thereby calculate an average value (Step S48). Then, the normalized average mass spectrum is displayed on the screen of the display unit 6 through the display processor 32 (Step S49).

Note that, in the case where a plurality of average mass spectra whose normalization conditions are different from each other are simultaneously displayed for comparison, average mass spectra obtained under a given normalization condition may be once held in the spectrum memory area 216 of the main memory 21, and such processing may be repeated. Then, if the average mass spectra to be displayed are prepared for all the normalization conditions, the prepared images may be simultaneously displayed on the screen of the display unit 6.

The procedures for creating normalized mass analysis result images and average mass spectra have been described above, and the following points should be noted when the intensity values of signals are treated on software. That is, although the intensity values of signals need to be treated within a range of a determined bit count as in data types called "long" and "short" on software, if the intensity values at each measurement point are multiplied by coefficients such as pi and qi at the time of normalization, the intensity values may exceed a range of a bit count that can be held by data types such as "long" and "short". In order to avoid this problem, a rescaling process may be performed at the time of normalization, whereby saturation of the signal values may be avoided. In the rescaling process, the intensity values at all the measurement points are multiplied by a constant smaller than 1 so as not to exceed the maximum value of "long" or "short". It is assumed here that in the case of performing XIC normalization the maximum value of the intensity values in the mass spectrum at the $i^{th}$ measurement point is Ii. Then, if the rescaling is performed so that the maximum value of Ii×pi is Max_long (Max_short) in all measurements, saturation of the signal values can be surely avoided. In order to achieve this, specifically, the following processing may be performed.

That is, first, the maximum value of Ii×pi is retrieved for every measurement point. It is assumed here that this value is maximum at the $a^{th}$ measurement point. At this time, because the rescaling may be performed so that Ia×pa is Max_long (Max_short), the intensity values at each measurement point may be multiplied by Max_long/(Ia×pa) or Max_short/(Ia×pa). In addition to the rescaling, the intensity values at each measurement point are multiplied by pi to be normalized. Hence, eventually, in the case of simultaneously performing the rescaling and the normalization, the intensity values at each measurement point may be multiplied by (Max_long×Pa)/(Ia×Pi) or (Max_short×Pa)/(Ia×Pi).

Note that, in order to avoid saturation by rescaling in the case of TIC normalization, pi, Pi, and Pmax described above may be respectively replaced with qi, Qi, and Qmax.

[Execution of Statistical Analysis]

As described above, an unnormalized peak matrix is initially stored in the peak matrix memory area 214 of the main memory 21. In the case of performing a statistical analysis process without normalization, the statistical analyzer 31 may read the unnormalized peak matrix out of the peak matrix memory area 214, and may perform a multivariate analysis such as a known principal component analysis, a network analysis, and other analyses. Meanwhile, in the case of performing a statistical analysis with TIC normalization or XIC normalization, the normalization processor 30 reads the unnormalized peak matrix out of the peak matrix memory area 214, and reads the TIC normalization coefficient or the XIC normalization coefficient calculated in advance out of the normalization coefficient memory area 213. Then, a normalized peak matrix is obtained by multiplying each intensity value array of the peak matrix by the normalization coefficient, and the normalized peak matrix may be used for the statistical analysis.

Figure 12:
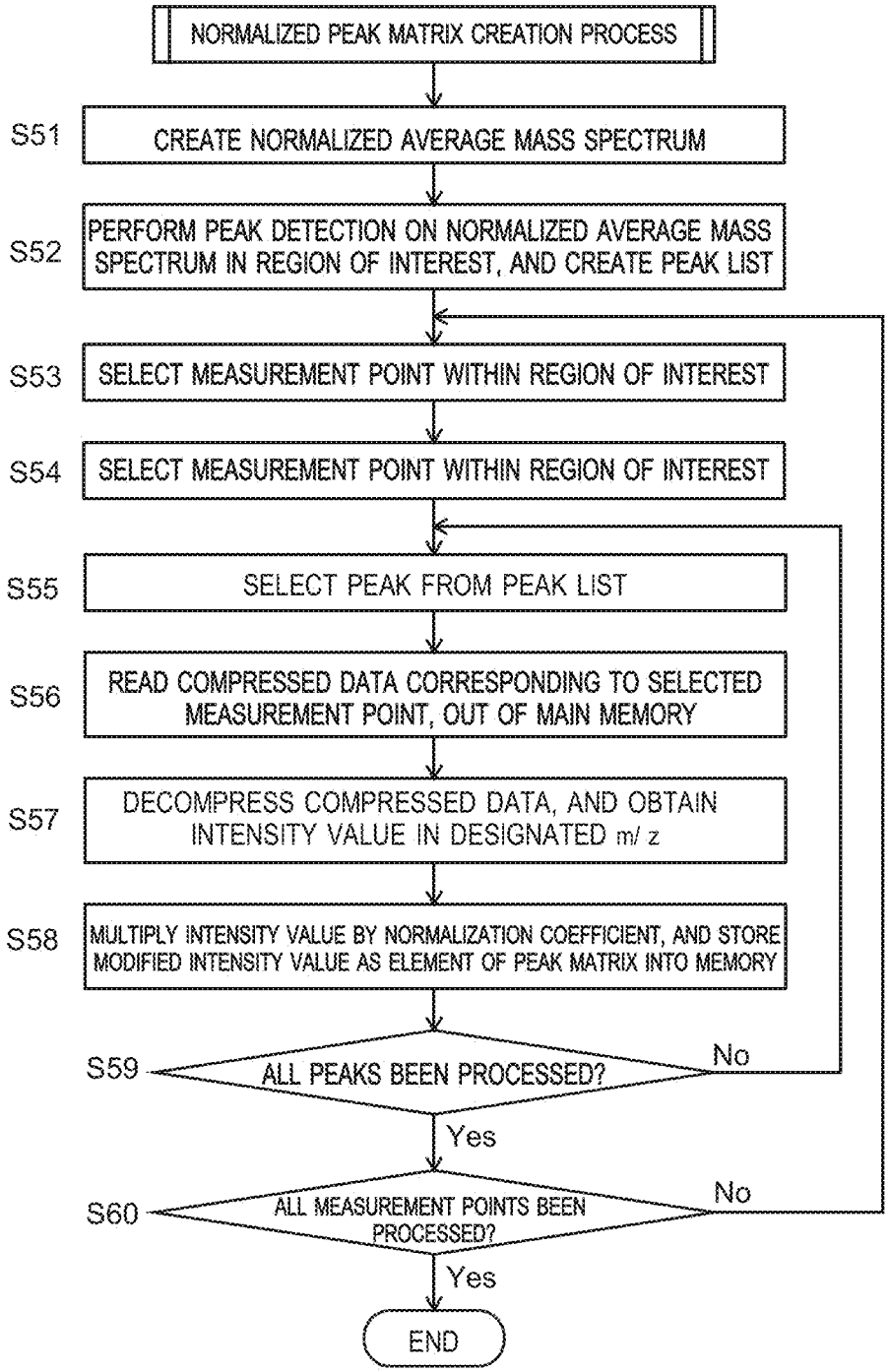
FIG. 12 is a flowchart showing a creation process of a normalized peak matrix in the imaging mass spectrometer system of the present embodiment.

Further, in the case where no unnormalized peak matrix is stored, a statistical process with normalization can be performed according to a flowchart shown in FIG. 12.

First, according to, for example, the processing shown in FIG. 11, a normalized average mass spectrum or maximum intensity mass spectrum in an entire measurement region or a designated region of interest is calculated with the use of: the compressed data stored in the compressed data memory area 211 of the main memory 21; and the TIC normalization coefficient or the XIC normalization coefficient stored in the normalization coefficient memory area 213 (Step S51). Subsequently, the peak matrix creator 27 performs peak detection on the average mass spectrum or the maximum intensity mass spectrum, and creates a peak list by extracting the mass-to-charge ratio values of the detected peaks (Step S52). The data decompressor 24 selects one measurement point within the region of interest (Step S53). The normalization processor 30 reads the TIC normalization coefficient or the XIC normalization coefficient that corresponds to the selected measurement point and is stored in the normalization coefficient memory area 213 of the main memory 21 (Step S54).

Subsequently, the data decompressor 24 selects one peak from the peak list created in Step S52 (Step S55), refers to the index that corresponds to the selected measurement point and is stored in the index memory area 212 of the main memory 21, and reads minimum necessary compressed data corresponding to the mass-to-charge ratio or mass-to-charge ratio range of the selected peak, from the compressed data of the selected measurement point stored in the compressed data memory area 211 of the main memory 21 (Step S56). Then, the ion intensity values at the selected measurement point in the designated mass-to-charge ratio or mass-to-charge ratio range are restored by performing a decoding process for decompressing the read compressed data (Step S57).

Subsequently, the normalization processor 30 multiplies each intensity value restored in Step S57 by the TIC normalization coefficient or the XIC normalization coefficient read in Step S54, to thereby modify the intensity value, and stores the modified intensity value as an element of the normalized peak matrix into the peak matrix memory area 214 of the main memory 21. Step S55 to Step S58 are repeated for one measurement point. If all the peaks have been processed (Yes in Step S59) and whether or not the processing for all the measurement points in the region of interest has been finished is determined (Step S60), the processing returns from Step S60 to Step S53, and another measurement point within the region of interest is newly selected, and Step S54 to Step S59 are repeated for the newly selected measurement point. The normalized peak matrix that can be eventually obtained through such processing may be used for the statistical analysis.

Note that, in the case where a plurality of statistical analysis results whose normalization conditions are different from each other are simultaneously displayed for comparison, the statistical analysis results for peak matrices that have been normalized under a given normalization condition may be once held in a memory area (not shown) of the main memory 21, and such processing may be repeated. Then, if the statistical analysis results to be displayed are prepared for all the normalization conditions, the prepared results may be simultaneously displayed on the screen of the display unit 6.

Note that the above-mentioned embodiment is a mere example of the present invention. Any change, modification, or addition appropriately made within the spirit of the present invention will naturally fall within the scope of claims of the present patent application.

For example, in the above-mentioned embodiment, indexes are created at the time of data compression, and rapid retrieval of necessary compressed data is enabled by using the indexes, but the use of the indexes is not essential to the present invention, and even the data compression is not essential to the present invention. The technique for a statistical analysis is not limited to one described above. The technique for ion intensity value normalization is not limited to one described above. In the above-mentioned embodiment, the processing procedures are described according to the flowcharts, but the order of steps in each procedure is not limited to one described above, and the order of some of the steps may be appropriately changed as a matter of course.

REFERENCE SIGNS LIST

1 . . . Imaging Mass Spectrometer Unit
2 . . . Data Processor
20 . . . Data Collector
21 . . . Main Memory
211 . . . Compressed Data Memory Area
212 . . . Index Memory Area
213 . . . Normalization Coefficient Memory Area
214 . . . Peak Matrix Memory Area
215 . . . Image Memory Area
216 . . . Spectrum Memory Area
22 . . . Data Combining Processor
23 . . . Data Compressor
24 . . . Data Decompressor
25 . . . Index Creator
26 . . . Normalization Coefficient Calculator
27 . . . Peak Matrix Creator
28 . . . Image Creator
29 . . . Mass Spectrum Creator
30 . . . Normalization Processor
31 . . . Statistical Analyzer
32 . . . Display Processor
4 . . . External Memory Device
40 . . . Uncompressed Imaging Mass Analysis Data Memory Area
41 . . . Microscopic Image Data Memory Area
5 . . . Operation Unit
6 . . . Display Unit
100 . . . Sample
101 . . . Measurement Region

The invention claimed is:

1. A mass spectrometry method, comprising:

a mass spectrum data acquiring step including performing a mass analysis on each of a plurality of measurement points on a first sample of a plurality of samples using an imaging mass spectrometer, performing a mass analysis on each of a plurality of measurement points on a second sample of the plurality of samples using the imaging mass spectrometer, and collecting mass spectrum data for each of the plurality of measurement points on the first and second samples;

a) a mass spectrum data associating step in which the mass spectrum data is associated with spatial position information of the plurality of measurement points to provide a plurality of imaging mass analysis data including imaging mass analysis data for the first sample and imaging mass analysis data for the second sample;

b) a spatial point interval equalization step in which a spatial measurement point interval in the plurality of imaging mass analysis data for one of the first and the second sample is defined as a reference, and mass spectrum data at each of a plurality of virtual measurement point positions in the other imaging mass analysis data for the other of the first and the second sample is obtained through interpolation or extrapolation using mass spectrum data at a plurality of measurement points around each of the plurality of virtual measurement point positions, the plurality of virtual measurement point positions being virtual positions in the other imaging mass analysis data in which a measurement point interval is equalized to the reference;

c) a mass-to-charge ratio equalization step in which a mass-to-charge ratio range common to mass spectra in the plurality of imaging mass analysis data is extracted, mass-to-charge ratio points within the extracted common mass-to-charge ratio range in the plurality of imaging mass analysis data for one of the first and the second sample are defined as references, and an intensity value at each of a plurality of virtual mass-to-charge ratio points in the other imaging mass analysis data for the other of the first and the second sample is obtained through interpolation using an intensity value at an actually measured mass-to-charge ratio point which is greater than the virtual mass-to-charge ratio point and an intensity value at the actually measured mass-to-charge ratio point which is smaller than the virtual mass-to-charge ratio point, or extrapolation using intensity values at a plurality of actually measured mass-to-charge ratio points which are greater than the virtual mass-to-charge ratio point or using intensity values at a plurality of actually measured mass-to-charge ratio points which are smaller than the virtual mass-to-charge ratio point, the virtual mass-to-charge ratio points in the other imaging mass analysis data being mass-to-charge ratio points in which mass-to-charge ratio points in the other imaging mass analysis data are equalized to the references;

d) a combining step, in which the plurality of imaging mass analysis data in which the measurement point intervals and the mass-to-charge ratio points are equalized by performing the spatial point interval equalization step and the mass-to-charge ratio equalization step are combined so as to be treatable as one imaging mass analysis data; and e) a displaying step in which a two-dimensional mass analysis result image for the samples is displayed based on the combined one imaging mass analysis data;

whereby the displayed two dimensional mass analysis image allows an operator to evaluate the imaging mass analysis data for the first sample and the imaging mass analysis data for the second sample that are displayed simultaneously together; and wherein the spatial point interval equalization step and the mass-to-charge ratio equalization step are performed by a processor.

2. The mass spectrometry method according to claim 1, further comprising:

f) a spectrum creation step, in which an arithmetic mass spectrum that is a summed mass spectrum, an average mass spectrum, or a maximum intensity mass spectrum of mass spectra at a plurality of designated or specific measurement points is calculated based on the imaging mass analysis data combined in the combining step;

g) a peak matrix creation step, in which peak detection is performed on the arithmetic mass spectrum, a list of mass-to-charge ratio values of the detected peaks is created, intensity values respectively corresponding to mass-to-charge ratios in the list are obtained from the mass spectrum data at each of the measurement points, and a peak matrix is created by arraying the intensity values in accordance with corresponding mass-to-charge ratio values; and h) a statistical analysis step, in which a statistical analysis is performed on the peak matrix.

3. The mass spectrometry method according to claim 2, further comprising i) an image creation step, in which a mass analysis result image showing two-dimensional distribution of unnormalized intensity values in a designated or specific mass-to-charge ratio or within a designated or specific mass-to-charge ratio range is created based on the imaging mass analysis data combined in the combining step.

4. The mass spectrometry method according to claim 3, further comprising a normalization coefficient creation step, in which a normalization coefficient for normalizing intensity values of mass spectrum data at each of a plurality of measurement points according to a predetermined reference is calculated for each of the measurement points, and the calculation result is stored, wherein the image creation step includes: normalizing intensity values at each of the measurement points on the mass analysis result image using the normalization coefficient; and creating a normalized mass analysis result image.

5. The mass spectrometry method according to claim 2, further comprising a normalization coefficient creation step, in which a normalization coefficient for normalizing intensity values of mass spectrum data at each of the measurement points according to a predetermined reference is calculated for each of the measurement points, and the calculation result is stored, wherein the spectrum creation step includes: normalizing mass spectra at a plurality of designated or specific measurement points using the normalization coefficient based on the imaging mass analysis data combined in the combining step; and calculating at least any one of a summed mass spectrum, an average mass spectrum, and a maximum intensity mass spectrum from the normalized mass spectra.

6. The mass spectrometry method according to claim 2, further comprising a compression step, in which, for the imaging mass analysis data combined in the combining step, mass spectrum data at each of the measurement points is compressed in a lossless manner according to a predetermined algorithm, and the resultant compressed data is stored into a memory unit, wherein any one of an arithmetic mass spectrum, a peak matrix, and a mass analysis result image is created by reading necessary data of the compressed data stored in the memory unit out of the memory unit and decompressing the read data.

7. The mass spectrometry method according to claim 6, wherein index information in which the compressed data is associated with position information of intensity values in an array of original data is stored in the memory unit in addition to the compressed data, and an intensity value corresponding to a specific mass-to-charge ratio is obtained with reference to the index information.

8. An imaging mass spectrometry system that provides the method of claim 1, the imaging mass spectrometry system comprising:

the imaging mass spectrometer for performing the mass spectrum acquiring step; and the processor for implementing the steps a) to e).

9. A mass spectrometry method, comprising:

a mass spectrum data acquiring step including performing a mass analysis on each of a plurality of measurement points on a first sample of a plurality of samples using an imaging mass spectrometer, performing a mass analysis on each of a plurality of measurement points on a second sample of the plurality of samples using the imaging mass spectrometer, and collecting mass spectrum data for each of the plurality of measurement points on the first and second samples;

a) a mass spectrum data associating step in which the mass spectrum data is associated with spatial position information of the plurality of measurement points to provide a plurality of imaging mass analysis data including imaging mass analysis data for the first sample and imaging mass analysis data for the second sample;

b) a spatial point interval equalization step in which a spatial measurement point interval in one of the plurality of imaging mass analysis data for one of the first and the second sample is defined as a reference, and a measurement point interval in the other imaging mass analysis data for the other of the first and the second sample is equalized to the reference through enlargement or shrinkage;

c) a mass-to-charge ratio equalization step in which a mass-to-charge ratio range common to mass spectra in the plurality of imaging mass analysis data is extracted, mass-to-charge ratio points within the extracted common mass-to-charge ratio range in one of the plurality of imaging mass analysis data for one of the first and the second sample are defined as references, and an intensity value at each of a plurality of virtual mass-to-charge ratio points in the other imaging mass analysis data for the other of the first and the second sample is obtained through interpolation using an intensity value at an actually measured mass-to-charge ratio point which is greater than the virtual mass-to-charge ratio point and an intensity value at the actually measured mass-to-charge ratio point which is smaller than the virtual mass-to-charge ratio point, or extrapolation using intensity values at a plurality of actually measured mass-to-charge ratio points which are greater than the virtual mass-to-charge ratio point or using intensity values at a plurality of actually measured mass-to-charge ratio points which are smaller than the virtual mass-to-charge ratio point, the virtual mass-to-charge ratio points in the other imaging mass analysis data being mass-to-charge ratio points in which mass-to-charge ratio points in the other imaging mass analysis data are equalized to the references;

d) a combining step, in which the plurality of imaging mass analysis data in which the measurement point intervals and the mass-to-charge ratio points are equalized by performing the spatial point interval equalization step and the mass-to-charge ratio equalization step are combined so as to be treatable as one imaging mass analysis data; and e) a displaying step in which a two-dimensional mass analysis result image for the samples is displayed based on the combined one imaging mass analysis data;

whereby the displayed two dimensional mass analysis image allows an operator to evaluate the imaging mass analysis data for the first sample and the imaging mass analysis data for the second sample that are displayed simultaneously together; and wherein the spatial point interval equalization step and the mass-to-charge ratio equalization step are performed by a processor.

10. The mass spectrometry method according to claim 9, further comprising:

f) a spectrum creation step, in which an arithmetic mass spectrum that is a summed mass spectrum, an average mass spectrum, or a maximum intensity mass spectrum of mass spectra at a plurality of designated or specific measurement points is calculated based on the imaging mass analysis data combined in the combining step;

g) a peak matrix creation step, in which peak detection is performed on the arithmetic mass spectrum, a list of mass-to-charge ratio values of the detected peaks is created, intensity values respectively corresponding to mass-to-charge ratios in the list are obtained from the mass spectrum data at each of the measurement points, and a peak matrix is created by arraying the intensity values in accordance with corresponding mass-to-charge ratio values; and h) a statistical analysis step, in which a statistical analysis is performed on the peak matrix.

11. The mass spectrometry method according to claim 10, further comprising i) an image creation step, in which a mass analysis result image showing two-dimensional distribution of unnormalized intensity values in a designated or specific mass-to-charge ratio or within a designated or specific mass-to-charge ratio range is created based on the imaging mass analysis data combined in the combining step.

12. The mass spectrometry method according to claim 11, further comprising a normalization coefficient creation step, in which a normalization coefficient for normalizing intensity values of mass spectrum data at each of measurement points according to a predetermined reference is calculated for each of the measurement points, and the calculation result is stored, wherein the image creation step includes: normalizing intensity values at each of the measurement points on the mass analysis result image using the normalization coefficient; and creating a normalized mass analysis result image.

13. The mass spectrometry method according to claim 10, further comprising a normalization coefficient creation step, in which a normalization coefficient for normalizing intensity values of mass spectrum data at each of the measurement points according to a predetermined reference is calculated for each of the measurement points, and the calculation result is stored, wherein the spectrum creation step includes: normalizing mass spectra at a plurality of designated or specific measurement points using the normalization coefficient based on the imaging mass analysis data combined in the combining step; and calculating at least any one of a summed mass spectrum, an average mass spectrum, and a maximum intensity mass spectrum from the normalized mass spectra.

14. The mass spectrometry method according to claim 10, further comprising a compression step, in which, for the imaging mass analysis data combined in the combining step, mass spectrum data at each of the measurement points is compressed in a lossless manner according to a predetermined algorithm, and the resultant compressed data is stored into a memory unit, wherein any one of an arithmetic mass spectrum, a peak matrix, and a mass analysis result image is created by reading necessary data of the compressed data stored in the memory unit out of the memory unit and decompressing the read data.

15. The mass spectrometry method according to claim 14, wherein index information in which the compressed data is associated with position information of intensity values in an array of original data is stored in the memory unit in addition to the compressed data, and an intensity value corresponding to a specific mass-to-charge ratio is obtained with reference to the index information.

16. A mass spectrometry method, comprising:

a mass spectrum data acquiring step including performing a mass analysis on each of a plurality of measurement points on a sample using an imaging mass spectrometer unit, and collecting mass spectrum data for each of the plurality of measurement points on the sample;

a) a mass spectrum data associating step in which the mass spectrum data is associated with spatial position information of the plurality of measurement points to provide imaging mass analysis data for the sample;

b) a spatial point interval equalization step, in which a specific spatial measurement point interval in a subset of the imaging mass analysis data is defined as a reference, and mass spectrum data at each of a plurality of virtual measurement point positions is obtained through interpolation or extrapolation using mass spectrum data at a plurality of measurement points around each of the plurality of virtual measurement point positions, the virtual measurement point positions being virtual positions in which a measurement point interval is equalized to the reference;

c) a mass-to-charge ratio equalization step, in which a mass-to-charge ratio range common to mass spectra at measurement points included in the subset of the imaging mass analysis data is extracted, mass-to-charge ratio points of a mass spectrum at a specific measurement point are defined as references, and an intensity value at each of a plurality of virtual mass-to-charge ratio points is obtained through interpolation using an intensity value at an actually measured mass-to-charge ratio point which is greater than the virtual mass-to-charge ratio point and an intensity value at the actually measured mass-to-charge ratio point which is smaller than the virtual mass-to-charge ratio point, or extrapolation using intensity values at a plurality of actually measured mass-to-charge ratio points which are greater than the virtual mass-to-charge ratio point or using intensity values at a plurality of actually measured mass-to-charge ratio points which are smaller than the virtual mass-to-charge ratio point, the virtual mass-to-charge ratio points being virtual mass-to-ratio point in which mass-to-charge ratio points constituting mass spectra at other measurement points are equalized to the references; and d) a displaying step in which a two-dimensional mass analysis result image for the sample is displayed based on the intensity value at each of the plurality of virtual mass-to-charge ratio points;

whereby the displayed two dimensional mass analysis image allows an operator to evaluate the imaging mass analysis data for the sample; and wherein the spatial point interval equalization step and the mass-to-charge ratio equalization step are performed by a processor.

17. A mass spectrometry method, comprising:

a mass spectrum data acquiring step including performing a mass analysis on each of a plurality of measurement points on a first sample of a plurality of samples using an imaging mass spectrometer, performing a mass analysis on each of a plurality of measurement points on a second sample of the plurality of samples using the imaging mass spectrometer, and collecting mass spectrum data for each of the plurality of measurement points on the first and second samples;

a) a mass spectrum data associating step in which the mass spectrum data is associated with spatial position information of the plurality of measurement points to provide a plurality of imaging mass analysis data including imaging mass analysis data for the first sample and imaging mass analysis data for the second sample;

b) a spatial point interval equalization step in which a spatial measurement point interval in the plurality of imaging mass analysis data for one of the first and the second sample is defined as a reference, and mass spectrum data at each of a plurality of virtual measurement point positions in other imaging mass analysis data for the other of the first and the second sample is obtained through interpolation or extrapolation using mass spectrum data at a plurality of measurement points around each of the plurality of virtual measurement point positions, the plurality of virtual measurement point positions being virtual positions in the other imaging mass analysis data in which a measurement point interval is equalized to the reference;

c) a combining step, in which the plurality of imaging mass analysis data in which the measurement point intervals is equalized by performing the spatial point interval equalization step are combined so as to be treatable as one imaging mass analysis data; and a displaying step in which a two-dimensional mass analysis result image for the samples is displayed based on the combined one imaging mass analysis data;

whereby the displayed two dimensional mass analysis image allows an operator to evaluate the imaging mass analysis data for the first sample and the imaging mass analysis data for the second sample that are displayed simultaneously together; and wherein the spatial point interval equalization step is performed by a processor.

18. The imaging mass analysis data processing method according to claim 17, wherein mass-to-charge ratio points of the plurality of imaging mass analysis data to be combined are common.

19. A mass spectrometry method, comprising:

a mass spectrum data acquiring step including performing a mass analysis on each of a plurality of measurement points on a first sample of a plurality of samples using an imaging mass spectrometer, performing a mass analysis on each of a plurality of measurement points on a second sample of the plurality of samples using the imaging mass spectrometer, and collecting mass spectrum data for each of the plurality of measurement points on the first and second samples;

a) a mass spectrum data associating step in which the mass spectrum data is associated with spatial position information of the plurality of measurement points to provide a plurality of imaging mass analysis data including imaging mass analysis data for the first sample and imaging mass analysis data for the second sample;

b) a mass-to-charge ratio equalization step in which a mass-to-charge ratio range common to mass spectra in the plurality of imaging mass analysis data is extracted, mass-to-charge ratio points within the extracted common mass-to-charge ratio range in the plurality of imaging mass analysis data for one of the first and the second sample are defined as references, and an intensity value at each of a plurality of virtual mass-to-charge ratio points in the other imaging mass analysis data for the other of the first and the second sample is obtained through interpolation using an intensity value at an actually measured mass-to-charge ratio point which is greater than the virtual mass-to-charge ratio point and an intensity value at the actually measured mass-to-charge ratio point which is smaller than the virtual mass-to-charge ratio point, or extrapolation using intensity values at a plurality of actually measured mass-to-charge ratio points which are greater than the virtual mass-to-charge ratio point or using intensity values at a plurality of actually measured mass-to-charge ratio points which are smaller than the virtual mass-to-charge ratio point, the virtual mass-to-charge ratio point in the other imaging mass analysis data being mass-to-charge ratio points in which mass-to-charge ratio points in the other imaging mass analysis data are equalized to the references;

c) a combining step, in which the plurality of imaging mass analysis data in which the mass-to-charge ratio points are equalized by performing the mass-to-charge ratio equalization step are combined so as to be treatable as one imaging mass analysis data; and d) a displaying step in which a two-dimensional mass analysis result image for the samples is displayed based on the combined one imaging mass analysis data;

whereby the displayed two dimensional mass analysis image allows an operator to evaluate the imaging mass analysis data for the first sample and the imaging mass analysis data for the second sample that are displayed simultaneously together; and wherein the mass-to-charge ratio equalization step is performed by a processor.

20. The imaging mass analysis data processing method according to claim 19, wherein measurement point intervals of the plurality of imaging mass analysis data to be combined are common.

21. A mass spectrometry method, comprising:

a mass spectrum data acquiring step including performing a mass analysis on each of a plurality of measurement points on a first sample of a plurality of samples using an imaging mass spectrometer, performing a mass analysis on each of a plurality of measurement points on a second sample of the plurality of samples using the imaging mass spectrometer, and collecting mass spectrum data for each of the plurality of measurement points on the first and second samples;

a) a mass spectrum data associating step in which the mass spectrum data is associated with spatial position information of the plurality of measurement points to provide a plurality of imaging mass analysis data including imaging mass analysis data for the first sample and imaging mass analysis data for the second sample;

b) a spatial point interval equalization step in which a spatial measurement point interval in one of a plurality of imaging mass analysis data is defined as a reference, and a measurement point interval in other imaging mass analysis data is equalized to the reference through enlargement or shrinkage; and c) a combining step, in which the plurality of imaging mass analysis data in which the measurement point intervals are equalized by performing the spatial point interval equalization step are combined so as to be treatable as one imaging mass analysis data; and d) a displaying step in which a two-dimensional mass analysis result image for the samples is displayed based on the combined one imaging mass analysis data;

whereby the displayed two dimensional mass analysis image allows an operator to evaluate the imaging mass analysis data for the first sample and the imaging mass analysis data for the second sample that are displayed simultaneously together; and wherein the spatial point interval equalization step is performed by a processor.

22. The imaging mass analysis data processing method according to claim 21, wherein mass-to-charge ratio points of the plurality of imaging mass analysis data to be combined are common.

23. A mass spectrometry method, comprising:

a mass spectrum data acquiring step including performing a mass analysis on each of a plurality of measurement points on a sample using an imaging mass spectrometer, and collecting mass spectrum data for each of the plurality of measurement points on the sample;

a mass spectrum data associating step in which the mass spectrum data is associated with spatial position information of the plurality of measurement points to provide imaging mass analysis data for the sample;

a spatial point interval equalization step, in which a specific spatial measurement point interval in a subset of the imaging mass analysis data is defined as a reference, and mass spectrum data at each of a plurality of virtual measurement point positions is obtained through interpolation or extrapolation using mass spectrum data at a plurality of measurement points around each of the plurality of virtual measurement point positions, the plurality of virtual measurement point positions being virtual positions in which a measurement point interval is equalized to the reference; and a displaying step in which a two-dimensional mass analysis result image for the sample is displayed based on the mass spectrum data at each of a plurality of virtual measurement point positions;

whereby the displayed two dimensional mass analysis image allows an operator to evaluate the imaging mass analysis data for the sample; and wherein the spatial point interval equalization step is performed by a processor.

24. A mass spectrometry method, comprising:

a mass spectrum data acquiring step including performing a mass analysis on each of a plurality of measurement points on a sample using an imaging mass spectrometer, and collecting mass spectrum data for each of the plurality of measurement points on the second sample;

a mass spectrum data associating step in which the mass spectrum data is associated with spatial position information of the plurality of measurement points to provide imaging mass analysis data for the sample;

a mass-to-charge ratio equalization step, in which a mass-to-charge ratio range common to mass spectra at measurement points included in a subset of the imaging mass analysis data is extracted, mass-to-charge ratio points of a mass spectrum at a specific measurement point are defined as references, and an intensity value at each of a plurality of virtual mass-to-charge ratio points is obtained through interpolation using an intensity value at an actually measured mass-to-charge ratio point which is greater than the virtual mass-to-charge ratio point and an intensity value at the actually measured mass-to-charge ratio point which is smaller than the virtual mass-to-charge ratio point, or extrapolation using intensity values at a plurality of actually measured mass-to-charge ratio points which are greater than the virtual mass-to-charge ratio point or using intensity values at a plurality of actually measured mass-to-charge ratio points which are smaller than the virtual mass-to-charge ratio point, the virtual mass-to-charge ratio points being virtual mass-to-ratio point in which mass-to-charge ratio points constituting mass spectra at other measurement points are equalized to the references; and a displaying step in which a two-dimensional mass analysis result image for the samples is displayed based on the intensity value at each of the plurality of virtual mass-to-charge ratio points;

whereby the displayed two dimensional mass analysis image allows an operator to evaluate the imaging mass analysis data for the sample; and wherein the mass-to-charge ratio equalization step is performed by a processor.

* * * * *